US008548350B2

(12) United States Patent
Hozumi et al.

(10) Patent No.: US 8,548,350 B2
(45) Date of Patent: Oct. 1, 2013

(54) CLEANING DEVICE AND IMAGE FORMING APPARATUS

(75) Inventors: Yoshiki Hozumi, Kanagawa (JP); Kenji Sugiura, Kanagawa (JP); Osamu Naruse, Kanagawa (JP); Naomi Sugimoto, Kanagawa (JP); Hisashi Kikuchi, Kanagawa (JP); Yuu Sakakibara, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 304 days.

(21) Appl. No.: 13/048,431

(22) Filed: Mar. 15, 2011

(65) Prior Publication Data

US 2011/0229234 A1 Sep. 22, 2011

(30) Foreign Application Priority Data

Mar. 18, 2010 (JP) ..... 2010-062537

(51) Int. Cl.
*G03G 15/16* (2006.01)
*G03G 21/00* (2006.01)

(52) U.S. Cl.
USPC ..... 399/101; 399/349; 399/354

(58) Field of Classification Search
USPC ..... 399/71, 101, 349, 353, 354, 355
See application file for complete search history.

(56) References Cited

U.S. PATENT DOCUMENTS 5,526,100 A 6/1996 Misago et al.
5,592,267 A 1/1997 Misago et al.
5,729,815 A * 3/1998 Lindblad et al. ..... 399/354
6,799,012 B2 9/2004 Shakuto et al.
6,987,944 B2 1/2006 Shakuto et al.
7,062,212 B2 6/2006 Naruse et al.
7,103,301 B2 9/2006 Watanabe et al.
7,123,872 B2 10/2006 Shakuto et al.
7,127,191 B2 * 10/2006 Mori et al. ..... 399/101
7,184,699 B2 2/2007 Naruse et al.
7,209,699 B2 4/2007 Yamaguchi et al.
7,369,807 B2 5/2008 Naruse et al.
7,376,380 B2 5/2008 Koike et al.
7,382,996 B2 * 6/2008 Lu et al. ..... 399/71
7,415,236 B2 8/2008 Nakano et al.
7,415,238 B2 8/2008 Watanabe et al.
7,433,626 B2 * 10/2008 Takeuchi ..... 399/101

(Continued)

FOREIGN PATENT DOCUMENTS

JP 04330482 A * 11/1992
JP 09325623 A * 12/1997

(Continued)

OTHER PUBLICATIONS

U.S. Appl. No. 12/913,335, filed Oct. 27, 2010, Kenji Sugiura, et al.

(Continued)

*Primary Examiner* — Robert Beatty
(74) *Attorney, Agent, or Firm* — Oblon, Spivak, McClelland, Maier & Neustadt, L.L.P.

(57) ABSTRACT

There is provided a pre-cleaning brush roller being a pre-cleaning member which is disposed on an upstream of a normally-charged-toner cleaning brush roller and an oppositely-charged-toner cleaning brush roller in a surface moving direction of an intermediate transfer belt, is applied with a voltage having a polarity opposite to a normal charge polarity of toner, and electrostatically removes the toner having the normal charge polarity.

10 Claims, 6 Drawing Sheets

(56) References Cited

U.S. PATENT DOCUMENTS

| | | | | |
|---|---|---|---|---|
| 7,496,324 | B2 | 2/2009 | Sugiura et al. | |
| 7,505,728 | B2 | 3/2009 | Yamaguchi et al. | |
| 7,603,071 | B2 | 10/2009 | Sugiura et al. | |
| 7,610,008 | B2 | 10/2009 | Watanabe et al. | |
| 7,620,357 | B2 | 11/2009 | Shakuto et al. | |
| 7,873,298 | B2 * | 1/2011 | Yamashita et al. | 399/99 |
| 7,945,202 | B2 * | 5/2011 | Kimura et al. | 399/353 |
| 8,045,881 | B2 * | 10/2011 | Sano et al. | 399/101 |
| 2008/0286020 | A1 | 11/2008 | Watanabe et al. | |
| 2009/0176669 | A1 | 7/2009 | Sugiura et al. | |
| 2010/0008706 | A1 * | 1/2010 | Sugiura et al. | 399/350 |
| 2011/0158677 | A1 * | 6/2011 | Kikuchi et al. | 399/101 |
| 2011/0229187 | A1 * | 9/2011 | Hozumi et al. | 399/101 |
| 2012/0008973 | A1 * | 1/2012 | Sakakibara et al. | 399/71 |

FOREIGN PATENT DOCUMENTS

| | | | |
|---|---|---|---|
| JP | 2002-202702 | | 7/2002 |
| JP | 2002221862 | A * | 8/2002 |
| JP | 2007-25173 | | 2/2007 |
| JP | 2007-72398 | | 3/2007 |

OTHER PUBLICATIONS

U.S. Appl. No. 12/923,856, filed Oct. 12, 2010, Unknown.
U.S. Appl. No. 12/955,320, filed Nov. 29, 2010, Kikuchi, et al.
U.S. Appl. No. 13/046,884, filed Mar. 14, 2011, Hozumi, et al.

* cited by examiner

CLEANING DEVICE AND IMAGE FORMING APPARATUS

CROSS-REFERENCE TO RELATED APPLICATIONS

The present application claims priority to and incorporates by reference the entire contents of Japanese Patent Application No. 2010-062537 filed in Japan on Mar. 18, 2010.

BACKGROUND OF THE INVENTION

1. Field of the Invention

The present invention relates to a cleaning device and an image forming apparatus.

2. Description of the Related Art

As a cleaning device adopted in an image forming apparatus such as a copier, a facsimile, and a printer, there is known a blade cleaning system for pressing a cleaning blade made of an elastic member against a circumferential surface of an image carrier being a body to be cleaned and removing toner on the image carrier by scraping off the toner. The blade cleaning system is widely used because of its simple configuration and stable performance.

In recent years, there are increasing demands for improvement of image quality, and to meet the demands, toner having a smaller particle size and a more spherical shape has been developed. The toner having the smaller particle size enables to obtain a high-resolution image which has a higher degree of accuracy and a higher definition, and the toner having the more spherical shape enables to improve a developing property and a transfer property.

However, when the toner having the smaller particle size and the more spherical shape is used, it is becoming difficult for an ordinary cleaning blade system to perform satisfactory cleaning. This is caused by the reason explained as follows. That is, the cleaning blade removes toner particles while slidably contacting the surface of the image carrier. However, because a portion of an edge of the cleaning blade is deformed, so-called stick slip, caused by a frictional resistance with the image carrier, there occurs a fine space between the image carrier and the cleaning blade. If the toner particles have the smaller particle size, then the toner particles more easily enter this space. If the toner particles having entered the space are closer to sphericity, then rotational moment is generated in the toner particles, and thus the toner particles easily rotate in the space. Therefore, the toner particles having the smaller particle size and the more spherical shape push up the cleaning blade and become easy to enter the space between the cleaning blade and the image carrier.

When the toner particles having the smaller particle size and the more spherical shape are to be used, it can be considered to enhance a pressing force (linear pressure) of the cleaning blade with respect to the image carrier, to prevent the toner particles from entering the space. However, by enhancing the pressing force to apply heavy load to the image carrier, the wearing of the image carrier and the cleaning blade proceeds, which causes their life to be extremely reduced. Recently, because prolonged life of the devices is required, such an inconvenience related to durability has to be avoided.

Like cleaning devices described in Japanese Patent Application Laid-open No. 2002-202702 and Japanese Patent Application Laid-open No. 2007-25173, by adopting an electrostatic cleaning system, even if toner is obtained through a polymerization method, the toner can be satisfactorily cleaned off. Moreover, even if the toner particles to be removed have positive and negative charge polarities, the toner particles can be satisfactorily cleaned off. The cleaning device described in Japanese Patent Application Laid-open No. 2002-202702 includes a conductive blade which is provided on the upstream of a cleaning brush being a cleaning member and is in contact with the image carrier, and to which a voltage having a polarity opposite to that of the cleaning brush is applied, the conductive blade being as a polarity control unit for changing the charge polarities of the toner particles to one of the polarities. According to the cleaning device described in Japanese Patent Application Laid-open No. 2002-202702, when residual toner after transfer passes through a position (blade contact position) where the conductive blade is in contact with the image carrier, the charge polarities of the toner particles are made the same as the charge polarity of the conductive blade (generally, normal charge polarity of toner), caused by charge injection from the conductive blade. In this way, the charge polarities of the toner particles having passed through the blade contact position and having reached a position (roller contact position) where the cleaning brush is in contact with the image carrier are made to be one of the polarities (same polarity as that of the conductive blade). Therefore, even if toner particles having a positive polarity and toner particles having a negative polarity coexist before the cleaning, they can be electrostatically collected by the cleaning brush.

The cleaning device described in Japanese Patent Application Laid-open No. 2007-25173 includes a first cleaning brush to which a voltage (positive polarity) having a polarity opposite to a normal charge polarity of toner is applied, and a second cleaning brush, provided on a downstream of the first cleaning brush, to which a voltage having the same polarity as the normal charge polarity of toner is applied. The toner having the normal charge polarity (negative polarity) on the image carrier is electrostatically attracted to the first cleaning brush being a normally-charged-toner cleaning member and is removed from the image carrier, and the toner having the polarity (positive polarity) opposite to the normal charge polarity on the image carrier is electrostatically attracted to the second cleaning brush being an oppositely-charged-toner cleaning member and is removed from the image carrier. This enables the toner having the positive polarity and the toner having the negative polarity to be removed from the image carrier.

However, in the cleaning devices configured as described in Japanese Patent Application Laid-open No. 2002-202702 and Japanese Patent Application Laid-open No. 2007-25173, when an un-transferred toner image such as a toner pattern in which a large amount of toner adheres to the image carrier is input to the cleaning device, the toner cannot be satisfactorily removed from the image carrier, which results in a cleaning failure.

Therefore, the present applicant(s) has proposed the following cleaning device in Japanese Patent Application No. 2009-293120. More specifically, in the cleaning device described in Japanese Patent Application Laid-open No. 2002-202702, a pre-cleaning brush, which roughly removes toner having a normal charge polarity, is provided on the upstream side of the polarity control unit in the image-carrier-surface moving direction, and in the cleaning device described in Japanese Patent Application Laid-open No. 2007-25173, the pre-cleaning brush is provided on the upstream side of the first cleaning brush in the image-carrier-surface moving direction. By providing the pre-cleaning brush in the above manner, at the time of inputting an un-transferred toner image to the cleaning device, the toner particles having the normal charge polarity, which occupy almost all of the toner particles that form the un-transferred toner image, are roughly removed by the pre-cleaning brush. Thus, the amount of toner to be input to the polarity control unit and the cleaning brush provided on the downstream side of the pre-cleaning brush is reduced. With this feature, the configuration on the downstream side of the pre-cleaning brush in the image-carrier moving direction enables satisfactory cleaning of the toner which cannot be removed by the pre-cleaning brush, in the configuration of the cleaning device described in Japanese Patent Application Laid-open No. 2002-202702 and the configuration of the cleaning device described in Japanese Patent Application Laid-open No. 2007-25173.

It is found that there remains a problem in the cleaning device proposed by the present applicant(s) that the life of the cleaning brush is unnecessarily reduced depending on setting of a biting depth of the cleaning brush, to the image carrier, which is provided on the downstream side of the pre-cleaning brush in the image-carrier moving direction or setting of a relative speed at its contact portion with the image carrier.

If the amount of the biting depth is larger, a contact width between the brush and the image carrier increases, and its cleaning property thereby increases. In addition, if the relative speed of the brush at the contact portion with the image carrier is faster, there is increased the number of contacts of a portion of the image carrier with the cleaning brush while the portion passes through a contact area with the cleaning brush, thus increasing the cleaning property. However, if the biting depth is set to be larger or the relative speed is made faster, the brush wears quickly, which causes the cleaning brush to be degraded early. Because the cleaning brush needs to remove a large amount of toner, the cleaning property has to be increased by setting the biting depth to be larger or making the relative speed faster. However, the amount of toner to be removed by the cleaning brush provided on the downstream side of the pre-cleaning brush in the image-carrier moving direction is less than that by the pre-cleaning brush. Therefore, the cleaning brush does not need the cleaning property as high as that of the pre-cleaning brush. As explained above, although the cleaning brush provided on the downstream side of the pre-cleaning brush in the image-carrier moving direction does not require the high cleaning property, if the biting depth of the cleaning brush provided on the downstream side and the relative speed thereof are set to the same values as these of the pre-cleaning brush, the life of the cleaning brush provided on the downstream side becomes shorter as compared with the case where the biting depth and the relative speed are set according to the cleaning capability required for the cleaning brush provided on the downstream side.

It is also found that there remains a problem in the proposed cleaning device that the life of the cleaning brush is unnecessarily reduced depending on setting of the biting depth of a collecting roller being a collecting member, to the cleaning brush, for collecting toner adhering to the cleaning brush which is provided on the downstream side of the pre-cleaning brush in the image-carrier moving direction, or depending on setting of the relative speed.

If the amount of the biting depth of the collecting roller to the cleaning brush is larger, a contact width between the brush and the collecting roller increases, and toner collecting capability of the collecting roller thereby increases. In addition, if the relative speed of the collecting roller to the brush is faster at the contact portion between the collecting roller and the cleaning brush, there is increased the contact width of the brush with the surface of the collecting roller in a period in which the brush passes through a contact range with the collecting roller, thus increasing the toner collecting capability of the collecting roller. However, if the biting depth is set to be larger or the relative speed is made faster, then, similarly to the above, the brush wears quickly, which causes the cleaning brush to be degraded early. Because a large amount of toner adheres to the pre-cleaning brush, in order to satisfactorily collect the toner, the toner collecting capability of the collecting roller has to be increased by setting the biting depth of the collecting roller to the brush to be larger or by making faster the relative speed of the collecting roller to the brush. However, the amount of toner adhering to the cleaning brush provided on the downstream side of the pre-cleaning brush is less than that of the pre-cleaning brush. Therefore, even if the toner collecting capability of the collecting roller is not so high, the collecting roller can excellently collect the toner adhering to the cleaning brush on the downstream side. Thus, the toner collecting capability of the collecting roller on the downstream side does not need to be made so high as the toner collecting capability of a pre-collecting roller. As explained above, the collecting roller for collecting toner adhering to the cleaning brush provided on the downstream side of the pre-cleaning brush in the image-carrier moving direction does not require the high cleaning property. Despite that, if the biting depth of the collecting roller on the downstream side and the relative speed thereof are set to the same values as these of the pre-collecting roller, the life of the cleaning brush provided on the downstream side becomes shorter as compared with the case where the biting depth and the relative speed are set according to the toner collecting capability of the collecting roller on the downstream side.

According to the present invention, when an un-transferred toner image is input to the cleaning device, the toner having the normal charge polarity, which occupies almost all of the toner forming the un-transferred toner image, is roughly removed by the pre-cleaning brush roller 101. This reduces each amount of toner input to the normally-charged-toner cleaning member and the oppositely-charged-toner cleaning member. The normally-charged-toner cleaning member electrostatically removes the remaining normally charged toner which cannot be removed by the pre-cleaning member, and the oppositely-charged-toner cleaning member electrostatically removes the toner having the polarity opposite to the normal charge polarity. Thus, even if the un-transferred toner image is input to the cleaning device, the toner can be satisfactorily cleaned off.

Moreover, the toner having the normal charge polarity which cannot be perfectly removed by the pre-cleaning member is electrostatically removed by the normally-charged-toner cleaning member, and, therefore, the following effect can be obtained. That is, the toner having the normal charge polarity, on the body to be cleaned, which cannot be perfectly removed by the pre-cleaning member can be satisfactorily removed as compared with the case where the toner having the normal charge polarity which cannot be perfectly removed by the pre-cleaning member is mechanically removed by the oppositely-charged-toner cleaning member like the cleaning device described in Japanese Patent Application Laid-open No. 2007-25173.

According to the present invention, when an un-transferred toner image is input to the cleaning device, the toner having the normal charge polarity, which occupies almost all of the toner forming the un-transferred toner image, is roughly removed by the pre-cleaning member. This causes the amount of toner, on the body to be cleaned, input to the polarity control unit to decrease, and the toner, on the body to be cleaned, having passed through the pre-cleaning member can be satisfactorily controlled to one of the polarities by the charge polarity control unit. Thus, the charge polarities of toner particles input to the cleaning member are made to one of the polarities and the amount of toner is small, and therefore, the toner on the body to be cleaned which cannot be removed by the pre-cleaning member can be satisfactorily removed. As a result, even if the un-transferred toner image is input to the cleaning device, it can be satisfactorily cleaned off.

By having at least one of the following four configurations, it is possible to prolong the life of the cleaning member provided on the downstream side of the pre-cleaning member in the moving direction of the body to be cleaned without lowering the cleaning property.

1. The relative speed of the cleaning member, to the body to be cleaned, provided on the downstream side of the pre-cleaning member in the moving direction of the body to be cleaned is set to be slower than the relative speed of the pre-cleaning member to the body to be cleaned.
2. The biting depth of the cleaning member, to the body to be cleaned, provided on the downstream side of the pre-cleaning member in the moving direction of the body to be cleaned is made less than the biting depth of the pre-cleaning member to the body to be cleaned.
3. The relative speed of the collecting member, to the cleaning member, for collecting the toner on the cleaning member provided on the downstream side of the pre-cleaning member in the moving direction of the body to be cleaned is set to be slower than the relative speed of the pre-collecting member to the pre-cleaning member.
4. The biting depth of the collecting member, to the cleaning member, for collecting the toner on the cleaning member provided on the downstream side of the pre-cleaning member in the moving direction of the body to be cleaned is made less than the biting depth of the pre-collecting member to the pre-cleaning member.

Like the present invention, by having the configuration 1, the wearing of the cleaning member, due to the body to be cleaned, provided on the downstream side of the pre-cleaning member in the moving direction of the body to be cleaned can be suppressed as compared with the case where the relative speed of the cleaning member is set to the same as the relative speed of the pre-cleaning member to the body to be cleaned. Therefore, the life of the cleaning member on the downstream side can be prolonged as compared with the case where the relative speed of the cleaning member, to the body to be cleaned, provided on the downstream side of the pre-cleaning member in the moving direction of the body to be cleaned is set to the same as the relative speed of the pre-cleaning member to the body to be cleaned.

If the relative speed of the cleaning member, to the body to be cleaned, provided on the downstream side of the pre-cleaning member in the moving direction of the body to be cleaned is set to be slower than the relative speed of the pre-cleaning member to the body to be cleaned, the cleaning property decreases. However, as explained above, because the cleaning device according to the present invention is provided with the pre-cleaning member and the toner on the body to be cleaned is removed by the pre-cleaning member, a small amount of toner is input to the cleaning member on the downstream side of the pre-cleaning member in the moving direction of the body to be cleaned. Therefore, even if the cleaning property of the cleaning member is not so high as that of the pre-cleaning member, the cleaning member can satisfactorily clean off the toner on the surface of the body to be cleaned. Because of this, even if the relative speed of the cleaning member, to the body to be cleaned, provided on the downstream side of the pre-cleaning member in the moving direction of the body to be cleaned is set to be slower than the relative speed of the pre-cleaning member to the body to be cleaned and the cleaning property is thereby lowered, a cleaning failure will never occur. Thus, even if the relative speed of the cleaning member, to the body to be cleaned, provided on the downstream side of the pre-cleaning member in the moving direction of the body to be cleaned is set to be slower than the relative speed of the pre-cleaning member to the body to be cleaned, excellent cleaning performance can be maintained.

Like the present invention, by having the configuration 2, the wearing of the cleaning member, due to the body to be cleaned, provided on the downstream side of the pre-cleaning member in the moving direction of the body to be cleaned can be suppressed as compared with the case where the biting depth of the cleaning member to the body to be cleaned is set to the same as the biting depth of the pre-cleaning member to the body to be cleaned. Therefore, the life of the cleaning member on the downstream side can be prolonged as compared with the case where the biting depth of the cleaning member on the downstream side to the body to be cleaned is set to the same as the biting depth of the pre-cleaning member to the body to be cleaned.

If the biting depth of the cleaning member, to the body to be cleaned, provided on the downstream side of the pre-cleaning member in the moving direction of the body to be cleaned is made less than the biting depth of the pre-cleaning member to the body to be cleaned, the cleaning property decreases. However, as explained above, because the cleaning device according to the present invention is provided with the pre-cleaning member and the toner on the body to be cleaned is removed by the pre-cleaning member, a small amount of toner is input to the cleaning member on the downstream side of the pre-cleaning member in the moving direction of the body to be cleaned. Therefore, even if the cleaning property of the cleaning member is not so high as that of the pre-cleaning member, the cleaning member can satisfactorily clean off the toner on the surface of the body to be cleaned. Because of this, even if the biting depth of the cleaning member, to the body to be cleaned, provided on the downstream side of the pre-cleaning member in the moving direction of the body to be cleaned is made less than the biting depth of the pre-cleaning member to the body to be cleaned and the cleaning property is thereby lowered, excellent cleaning performance can be maintained.

Like the present invention, by having the configuration 3, the wearing of the cleaning member, due to the collecting member, provided on the downstream side of the pre-cleaning member in the moving direction of the body to be cleaned can be suppressed as compared with the case where the relative speed of the collecting member to the cleaning member is set to the same as the relative speed of the pre-collecting member to the pre-cleaning member. Thus, the life of the cleaning member on the downstream side can be prolonged as compared with the case where the relative speed of the collecting member, to the cleaning member, for collecting the toner on the cleaning member provided on the downstream side of the pre-cleaning member in the moving direction of the body to be cleaned is set to the same as the relative speed of the pre-collecting member to the pre-cleaning member.

If the relative speed of the collecting member to the cleaning member is reduced, the toner collecting capability of the collecting member decreases. When the relative speed of the collecting member to the cleaning member is reduced and the toner collecting capability of the collecting member is lowered, the toner cannot be collected to the collecting member, which may cause uncollected toner remaining on the cleaning member to increase. If the uncollected toner remaining on the cleaning member increases, the amount of new toner to adhere from the body to be cleaned to the cleaning member decreases, which may cause the cleaning property to decrease. However, as explained above, because the present invention is configured to remove the toner on the body to be cleaned by the pre-cleaning member, a small amount of toner is input to the cleaning member on the downstream side of the pre-cleaning member in the moving direction of the body to be cleaned. Therefore, because a small amount of the toner adheres to the cleaning member on the downstream side, even if the toner collecting capability of the collecting member is decreased, the toner on the cleaning member can be satisfactorily collected. Thus, even if the relative speed of the collecting member, to the cleaning member, for collecting the toner on the cleaning member on the downstream side of the pre-cleaning member in the moving direction of the body to be cleaned is set to be slower than the relative speed of the pre-collecting member to the pre-cleaning member, and even if the collecting capability is thereby decreased, excellent cleaning performance can be maintained.

Like the present invention, by having the configuration 4, the wearing of the cleaning member, due to the collecting member, provided on the downstream side of the pre-cleaning member in the moving direction of the body to be cleaned can be suppressed as compared with the case where the biting depth of the collecting member to the cleaning member is set to the same as the biting depth of the pre-collecting member to the pre-cleaning member. Therefore, the life of the cleaning member on the downstream side can be prolonged as compared with the case where the biting depth of the collecting member, to the cleaning member, for collecting the toner on the cleaning member provided on the downstream side of the pre-cleaning member in the moving direction of the body to be cleaned is set to the same as the biting depth of the pre-collecting member to the pre-cleaning member.

If the biting depth of the collecting member to the cleaning member is reduced, the toner collecting capability of the collecting member decreases. When the toner collecting capability of the collecting member decreases, the cleaning property may decrease similarly to the above. However, as explained above, because the present invention is configured to remove the toner on the body to be cleaned by the pre-cleaning member, a small amount of toner is input to the cleaning member on the downstream side of the pre-cleaning member in the moving direction of the body to be cleaned. Therefore, because there is a small amount of the toner to adhere to the cleaning member on the downstream side, even if the toner collecting capability of the collecting member is decreased, the toner on the cleaning member can be satisfactorily collected. Thus, even if the biting depth of the collecting member, to the cleaning member, for collecting the toner on the cleaning member provided on the downstream side of the pre-cleaning member in the moving direction of the body to be cleaned is made less than the biting depth of the pre-collecting member to the pre-cleaning member and the collecting capability is decreased, excellent cleaning performance can be maintained.

SUMMARY OF THE INVENTION

It is an object of the present invention to at least partially solve the problems in the conventional technology.

According to an aspect of the present invention a cleaning device includes: a normally-charged-toner cleaning member that is in contact with a body to be cleaned while rotating, and is applied with a voltage having a polarity opposite to a normal charge polarity of toner, to electrostatically remove the toner having the normal charge polarity on the body to be cleaned; an oppositely-charged-toner cleaning member that is in contact with the body to be cleaned while rotating, and is applied with a voltage having a same polarity as the normal charge polarity of toner, to electrostatically remove toner having a polarity opposite to the normal charge polarity on the body to be cleaned; and a pre-cleaning member that is provided on an upstream of the normally-charged-toner cleaning member and the oppositely-charged-toner cleaning member in a surface moving direction of the body to be cleaned, is in contact with the body to be cleaned while rotating, and is applied with a voltage having a polarity opposite to the normal charge polarity of toner, to electrostatically remove the toner having the normal charge polarity, and a relative speed of the normally-charged-toner cleaning member to the body to be cleaned at a contact portion between the normally-charged-toner cleaning member and the body to be cleaned and a relative speed of the oppositely-charged-toner cleaning member to the body to be cleaned at a contact portion between the oppositely-charged-toner cleaning member and the body to be cleaned are made slower than a relative speed of the pre-cleaning member to the body to be cleaned at a contact portion between the pre-cleaning member and the body to be cleaned, a biting depth of the normally-charged-toner cleaning member to the body to be cleaned and a biting depth of the oppositely-charged-toner cleaning member to the body to be cleaned are made less than a biting depth of the pre-cleaning member to the body to be cleaned, a relative speed of an oppositely-charged-toner collecting member, to the oppositely-charged-toner cleaning member, for collecting toner adhering to the oppositely-charged-toner cleaning member at a contact portion between the oppositely-charged-toner collecting member and the oppositely-charged-toner cleaning member and a relative speed of a normally-charged-toner collecting member, to the normally-charged-toner cleaning member, for collecting toner adhering to the normally-charged-toner cleaning member at a contact portion between the normally-charged-toner collecting member and the normally-charged-toner cleaning member are made slower than a relative speed of a pre-collecting member, to the pre-cleaning member, for collecting toner adhering to the pre-cleaning member at a contact portion between the pre-collecting member and the pre-cleaning member, or a biting depth of the normally-charged-toner collecting member to the normally-charged-toner cleaning member and a biting depth of the oppositely-charged-toner collecting member to the oppositely-charged-toner cleaning member are made less than a biting depth of the pre-collecting member to the pre-cleaning member.

According to another aspect of the present invention, a cleaning device includes: a polarity control unit that controls a charge polarity of toner on a body to be cleaned; a cleaning member that is provided on a downstream of the polarity control unit in a surface moving direction of the body to be cleaned, is applied with a voltage having a polarity opposite to the charge polarity of the toner controlled by the polarity control unit, and electrostatically removes the toner; and a pre-cleaning member that is provided on an upstream of the polarity control unit in the surface moving direction of the body to be cleaned, is applied with a voltage having a polarity opposite to a normal charge polarity of the toner, and electrostatically removes the toner having the normal charge polarity, and a relative speed of the cleaning member to the body to be cleaned at a contact portion between the cleaning member and the body to be cleaned is set to be slower than a relative speed of the pre-cleaning member to the body to be cleaned at a contact portion between the pre-cleaning member and the body to be cleaned, a biting depth of the cleaning member to the body to be cleaned is made less than a biting depth of the pre-cleaning member to the body to be cleaned, a biting depth of a toner collecting member for collecting toner adhering to the cleaning member to the cleaning member is made less than a biting depth of a pre-collecting member for collecting toner adhering to the pre-cleaning member to the pre-cleaning member, or a relative speed of the toner collecting member to the cleaning member at a contact portion between the toner collecting member and the cleaning member is set to be slower than a relative speed of the pre-collecting member to the pre-cleaning member at a contact portion between the pre-collecting member and the pre-cleaning member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
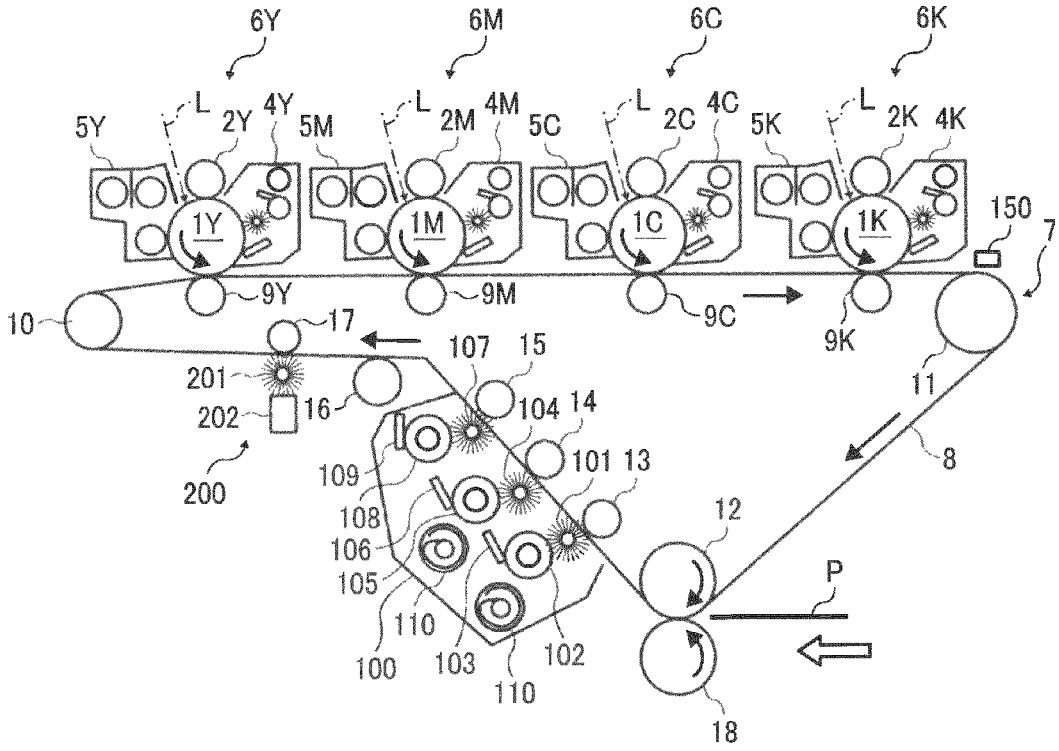
FIG. 1 is a schematic configuration diagram representing a main portion of a printer according to an embodiment.

As embodiments of an image forming apparatus to which the present invention is applied, a printer of a so-called tandem-type intermediate transfer system (hereinafter, simply called "printer") will be explained below. First, a basic configuration of a present printer will be explained below. FIG. 1 is a schematic configuration diagram representing a main portion of the printer. The printer includes four process units 6Y, 6M, 6C, and 6K for generating toner images of yellow, magenta, cyan, and black (hereinafter, described as Y, M, C, and K). The four process units 6Y, 6M, 6C, and 6K include drum-type photosensitive elements 1Y, 1M, 1C, and 1K, respectively. Arranged around the photosensitive elements 1Y, 1M, 1C, and 1K are charging devices 2Y, 2M, 2C, and 2K; developing devices 5Y, 5M, 5C, and 5K; drum cleaning devices 4Y, 4M, 4C, and 4K; and decharging devices (not shown), respectively. The process units 6Y, 6M, 6C, and 6K use Y, M, C, K toners as mutually different colors, but the rest of the configurations are the same as one another. Disposed above the process units 6Y, 6M, 6C, and 6K is an optical writing unit (not shown) to irradiate the surfaces of the photosensitive elements 1Y, 1M, 1C, and 1K with laser lights L and write electrostatic latent images thereto, respectively.

Disposed under the process units 6Y, 6M, 6C, and 6K is a transfer unit 7 as a belt device that includes an endless intermediate transfer belt 8 being a belt member. The transfer unit 7 includes, in addition to the intermediate transfer belt 8, a plurality of stretching rollers arranged inside a loop of the intermediate transfer belt 8; and a secondary transfer roller 18, a tension roller 16, a belt cleaning device 100, and a lubricant applying device 200, which are arranged outside the loop thereof.

Arranged inside the loop of the intermediate transfer belt 8 are four primary transfer rollers 9Y, 9M, 9C, and 9K, a driven roller 10, a drive roller 11, a secondary-transfer opposed roller 12, three cleaning opposed rollers 13, 14, and 15, and an applying-brush opposed roller 17. Each of the rollers functions as a stretching roller for winding the intermediate transfer belt 8 around part of its circumferential surface to stretch the belt. As conditions required for the cleaning opposed rollers 13, 14, and 15, they do not necessarily have a function of applying fixed tensile force, and thus may rotate following a rotation of the intermediate transfer belt 8. The intermediate transfer belt 8 is made to endlessly rotate in a clockwise direction in this figure through a rotation of the drive roller 11 driven to rotate in the clockwise direction in this figure by a drive unit (not shown).

The four primary transfer rollers 9Y, 9M, 9C, and 9K arranged inside the belt loop sandwich the intermediate transfer belt 8 with the photosensitive elements 1Y, 1M, 1C, and 1K. This forms primary transfer nips for Y, M, C, and K where the top side of the intermediate transfer belt 8 is in contact with the photosensitive elements 1Y, 1M, 1C, and 1K, respectively. Applied to the primary transfer rollers 9Y, 9M, 9C, and 9K is primary transfer bias having a polarity opposite to that of toner by power supplies (not shown), respectively.

The secondary-transfer opposed roller 12 provided inside the belt loop sandwiches the intermediate transfer belt 8 with the secondary transfer roller 18 provided outside the belt loop. This forms a secondary transfer nip where the top side of the intermediate transfer belt 8 is in contact with the secondary transfer roller 18. Applied to the secondary transfer roller 18 is secondary transfer bias having a polarity opposite to that of toner by a power supply (not shown). Moreover, a paper transfer belt may be stretched by the secondary transfer roller, several pieces of support rollers, and the drive roller, so that the intermediate transfer belt 8 and the paper conveyor belt may be sandwiched between the secondary transfer roller 18 and the secondary-transfer opposed roller 12.

The three cleaning opposed rollers 13, 14, and 15 arranged inside the belt loop sandwich the intermediate transfer belt 8 with cleaning brush rollers 101, 104, and 107 of the belt cleaning device 100 provided outside the belt loop. This forms cleaning nips where the top side of the intermediate transfer belt 8 is in contact with the cleaning brush rollers 101, 104, and 107, respectively. The belt cleaning device 100 is integrally replaceable with the intermediate transfer belt 8. However, when setting of the life of the belt cleaning device 100 is different from that of the intermediate transfer belt 8, then the belt cleaning device 100 may be separated from the intermediate transfer belt 8 and replaceably attached to a body of the printer. Details of the belt cleaning device 100 will be explained later.

The printer is provided with a paper feed unit (not shown) that includes a paper feed cassette for storing therein recording papers P and a paper feed roller for feeding a recording paper P from the paper feed cassette to a paper feed path. The printer is also provided with a registration roller pair (not shown), in the right side of the secondary transfer nip in the figure, for receiving the recording paper fed from the paper feed unit and feeding the recording paper toward the secondary transfer nip at a predetermined timing. In addition, the printer is provided with a fixing device (not shown), in the left side of the secondary transfer nip in the figure, for receiving the recording paper P fed from the secondary transfer nip and subjecting the recording paper P to a fixing process for a toner image. There are provided toner supply devices for Y, M, C, and K (not shown) for supplying Y, M, C, and K toners to the developing devices 5Y, 5M, 5C, and 5K, respectively, as required.

Recently, in addition to a plain paper which is widely used as a recording paper, a special paper with a rough surface as design and a special recording paper used for thermal transfer such as iron-printing are increasingly used. When these special papers are used, a transfer failure more easily occurs than that in the conventional plain papers at the time of secondarily transferring the toner image, in which the color toners are superimposed on one another, on the intermediate transfer belt 8 to the paper. Therefore, in the printer, a low-hardness elastic layer is provided on the intermediate transfer belt 8, so that the elastic layer can be deformed with respect to the toner layer and a low-smoothness recording paper at the transfer nip. By providing the low-hardness elastic layer on the intermediate transfer belt 8 to make the intermediate transfer belt 8 elastic, the surface of the intermediate transfer belt 8 can be deformed following local rough parts. This enables an excellent adhesion property to be obtained without excessively increasing a transfer pressure to the toner layer and a transferred image excellent in uniformity with no transfer omission of character and without uneven transfer to the low-smoothness paper and the like to be obtained.

In the printer, the intermediate transfer belt 8 is formed by at least a base layer, an elastic layer, and a coat layer for the surface.

A material used for the elastic layer of the intermediate transfer belt 8 includes an elastic member such as elastic rubber and elastomer. More specifically, one or more materials selected from the following group can be used: butyl rubber, fluorine-based rubber, acrylic rubber, EPDM, NBR, acrylonitrile-butadiene-styrene rubber, natural rubber, isoprene rubber, styrene-butadiene rubber, butadiene rubber, urethane rubber, syndiotactic 1,2-polybutadiene, epichlorohydrin-based rubber, polysulfide rubber, polynorbornene rubber, thermoplastic elastomer (e.g., polystyrene-based, polyolefin-based, polyvinylchloride-based, polyurethane-based, polyamide-based, polyurea, polyester-based, and fluorine resin-based one), etc. However, the elastic member does not need to be limited to the materials.

The thickness of the elastic layer is preferably a range of 0.07 to 0.5 mm depending on its hardness and its structure. A range of 0.25 to 0.5 mm is more preferable. In addition, if the thickness of the intermediate transfer belt 8 is as thin as 0.07 mm or less, the pressure to the toner on the intermediate transfer belt 8 at the secondary transfer nip portion increases, and transfer omission thereby easily occurs and a transfer ratio of the toner decreases.

The hardness of the elastic layer is preferably $10° \leq HS \leq 65°$ (JIS-A). An optimal hardness is different depending on the layer thickness of the intermediate transfer belt 8, however, if the hardness is lower than 10° JIS-A, transfer omission easily occurs. Meanwhile, if the hardness is higher than 65° JIS-A, the belt is difficult to be stretched around the roller, and is not durable because the length of the belt increases due to long-term stretching, which requires early replacement thereof.

The base layer of the intermediate transfer belt 8 is made of less stretchy resin. More specifically, as a material used for the base layer, one or more materials selected from the following group can be used: polycarbonate; fluorine resin (ETFE, PVDF, etc.); styrene-based resin (homopolymer or copolymer including styrene or styrene substitute) such as polystyrene, chloro-polystyrene, poly-α-methylstyrene, styrene-butadiene copolymer, styrene-vinyl chloride copolymer, styrene-vinyl acetate copolymer, styrene-maleic acid copolymer, styrene-acrylic acid ester copolymer (styrene-acrylic acid methyl copolymer, styrene-acrylic acid ethyl copolymer, styrene-acrylic acid butyl copolymer, styrene-acrylic acid octyl copolymer, and styrene-acrylic acid phenyl copolymer, etc.), styrene-methacrylic acid ester copolymer (styrene-methacrylic acid methyl copolymer, styrene-methacrylic acid ethyl copolymer, and styrene-methacrylic acid phenyl copolymer, etc.), styrene-α-chloroacrylic acid methyl copolymer, and styrene-acrylonitrile-acrylic acid ester copolymer; methacrylic acid methyl resin, methacrylic acid butyl resin, acrylic acid ethyl resin, acrylic acid butyl resin, modified acrylic resin (silicone modified acrylic resin, vinyl chloride resin modified acrylic resin, and acrylic urethane resin, etc.), vinyl chloride resin, styrene-vinyl acetate copolymer, vinyl chloride-vinyl acetate copolymer, rosin modified maleic acid resin, phenol resin, epoxy resin, polyester resin, polyester-polyurethane resin, polyethylene, polypropylene, polybutadiene, polyvinylidene chloride, ionomer resin, polyurethane resin, silicone resin, ketone resin, ethylene-ethyl acrylate copolymer, xylene resin, polyvinyl butyral resin, polyamide resin, and modified polyphenylene oxide resin. However, the material is not limited to the materials.

In order to prevent stretch of the elastic layer made of a high stretchy rubber material or the like, a core body layer made of a material such as canvas may be provided between the base layer and the elastic layer. As a stretch-preventing material used for the core body layer, one or more materials selected from the following group are used and yarn or cloth can be used: natural fiber such as cotton and silk; synthetic fiber such as polyester fiber, nylon fiber, acrylic fiber, polyolefine fiber, polyvinylalcohol fiber, polyvinyl chloride fiber, polyvinylidene chloride fiber, polyurethane fiber, polyacetal fiber, polyfluoroethylene fiber, and phenol fiber; inorganic fiber such as carbon fiber and glass fiber; and metal fiber such as iron fiber and cupper fiber. However, the material is not limited to the above materials. In addition, the yarn can be obtained by twisting a single filament or a plurality of filaments, or can be single-ply yarn, plied yarn, and two-ply yarn, that is, any one of twisting methods is acceptable. Further, the fibers selected from the material group may be mixed. It goes without saying that the yarn subjected to an appropriate conductive process can be used. Meanwhile, as the cloth, any cloth can be used regardless of weaving methods such as a knitting method. Union cloth can also be used, and the cloth can be subjected to the conductive process.

The coat layer for the surface of the intermediate transfer belt 8 is used to coat the surface of the elastic layer and is formed by a high-smoothness layer. A material used for the coat layer is not particularly limited. However, there is generally used a material for making smaller an adhesion of toner to the surface of the intermediate transfer belt 8 to increase a secondary transfer property. There can be used a material obtained by dispersing one or more types of polyurethane, polyester, epoxy resin, and so on; or dispersing a material for making smaller surface energy to increase a lubricating property, such as one or more types of particles of fluorine resin, fluorine compound, carbon fluoride, titanium oxide, and silicon carbide; or dispersing those whose particle sizes are changed as required. There can be also used a material whose surface is formed with a fluoride layer by performing a heat process on the material like a fluorine-based rubber material and its surface energy is made smaller.

In addition, for the base layer, the elastic layer, or the coat layer, in order to adjust resistance, there can be used, if necessary, carbon black, graphite, metal powders made of, for example, aluminum and nickel, and conductive metal oxides such as tin oxide, titanium oxide, antimony oxide, indium oxide, potassium titanate, composite oxide of antimony oxide-tin oxide (ATO), and composite oxide of indium oxide-tin oxide (ITO). The conductive metal oxide can be coated with insulation particles such as barium sulfate, magnesium silicate, and calcium carbonate. However, the conductive material is not limited to the above materials.

The surface of the intermediate transfer belt 8 is applied with a lubricant by the lubricant applying device 200 in order to protect the belt surface. The lubricant applying device 200 is provided with a solid lubricant 202 such as a lump of zinc stearate, and an applying brush roller 201 being an application member which is in contact with the solid lubricant and applies lubricant powder obtained by scraping the solid lubricant through its rotation, to the surface of the intermediate transfer belt 8.

When image information is sent from a personal computer or the like, the printer drives to rotate the drive roller 11 to endlessly move the intermediate transfer belt 8. The stretching rollers other than the drive roller 11 are driven following the belt. At the same time, the photosensitive elements 1Y, 1M, 1C, and 1K of the process units 6Y, 6M, 6C, and 6K are driven to rotate, respectively. While the surfaces of the photosensitive elements 1Y, 1M, 1C, and 1K are uniformly charged by the charging devices 2Y, 2M, 2C, and 2K, laser lights L are irradiated to the charged surfaces to form electrostatic latent images thereon, respectively. The electrostatic latent images formed on the surfaces of the photosensitive elements 1Y, 1M, 1C, and 1K are developed by the developing devices 5Y, 5M, 5C, and 5K, to obtain Y, M, C, and K toner images on the photosensitive elements 1Y, 1M, 1C, and 1K, respectively. The Y, M, C, and K toner images are superimposed on and primarily transferred to the top side of the intermediate transfer belt 8 at the primary transfer nips for Y, M, C, and K, respectively. In this way, four-color superimposed toner images are formed on the top side of the intermediate transfer belt 8.

Meanwhile, in the paper feed unit, the recording papers P are fed sheet by sheet from the paper feed cassette by a paper feed roller 27 to be conveyed to the registration roller pair. The registration roller pair is driven and the recording paper P is fed into the secondary transfer nip at timing capable of synchronizing the paper with the four-color superimposed toner images on the intermediate transfer belt 8, and the four-color superimposed toner images on the belt are collectively secondarily transferred to the recording paper P. The full-color image is thereby formed on the surface of the recording paper P. The recording paper P after the full-color image is formed thereon is conveyed to the fixing device from the secondary transfer nip, and the toner image is subjected to a fixing process.

The photosensitive elements 1Y, 1M, 1C, and 1K after the Y, M, C, and K toner images are primarily transferred to the intermediate transfer belt 8 are subjected to a cleaning process for the residual toner after transfer by the drum cleaning devices 4Y, 4M, 4C, and 4K, respectively. Thereafter, the photosensitive elements 1Y, 1M, 1C, and 1K are decharged by decharging lamps (not shown), and are uniformly charged by the charging devices 2Y, 2M, 2C, and 2K for next image formation. In addition, the intermediate transfer belt 8 after the toner images are secondary transferred to the recording paper P are subjected to a cleaning process for the residual toner after transfer by the belt cleaning device 100.

Figure 2:
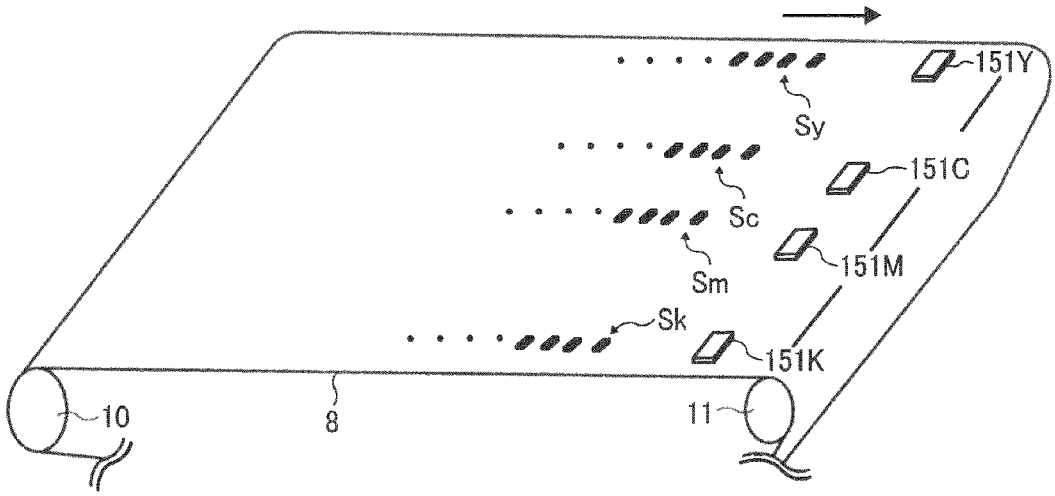
FIG. 2 is an enlarged schematic configuration diagram near an intermediate transfer belt representing gray-scale patterns and optical sensors.

Disposed in the right-hand side in this figure of the process unit 6K for K is an optical sensor unit 150 so as to face the top side of the intermediate transfer belt 8 through a predetermined space. The optical sensor unit 150 includes, as shown in FIG. 2, a Y optical sensor 151Y, a C optical sensor 151C, an M optical sensor 151M, and a K optical sensor 151K along the width direction of the intermediate transfer belt 8. Each of the optical sensors is formed by a reflective photosensor, and is configured to cause the light emitted from a light-emitting element (not shown) to be reflected by the top side of the intermediate transfer belt 8 or by the toner image on the belt and detect the amount of light reflected therefrom by a light-receiving element (not shown). A controller (not shown) can detect the toner images on the intermediate transfer belt 8 and detect each density of the images (toner adhesion amount per unit area) based on each output voltage value from the sensors.

The printer executes image density control in order to control the image density of each color to an appropriate value each time the power is turned on or a predetermined number of sheets is printed.

The image density control is implemented first in such a manner that gray-scale patterns Sk, Sm, Sc, and Sy for the colors as shown in FIG. 2 are automatically formed at positions facing the optical sensors 151Y, 151C, 151M, and 151K on the intermediate transfer belt 8, respectively. Each of the gray-scale patterns for the colors is formed from ten toner patches with different image densities and each with an area of 2 cm×2 cm. As for each charge potential of the photosensitive elements 1Y, 1M, 1C, and 1K when the gray-scale patterns Sk, Sm, Sc, and Sy for the colors are to be formed, its value is getting increased, which is different from a uniform drum charge potential in the print process. A plurality of patch electrostatic latent images for forming gray-scale pattern images by scanning of laser lights are formed on the photosensitive elements 1Y, 1M, 1C, and 1K, respectively, and these images are developed by the developing devices 5Y, 5M, 5C, and 5K for Y, M, C, and K. During the development, values of developing bias applied to developing rollers for Y, M, C, and K are gradually increased. With such development, the gray-scale pattern images of Y, M, C, and K are formed on the photosensitive elements 1Y, 1M, 1C, and 1K, respectively. These images are primarily transferred to the intermediate transfer belt 8 in a main scanning direction so as to be aligned at predetermined intervals. The toner adhesion amount of each toner patch in the gray-scale patterns for the colors at this time is about 0.1 mg/cm$^2$ at minimum and about 0.55 mg/cm$^2$ at maximum. In addition, as a result of measuring toner Q/d distribution, the polarities are nearly normal charging polarities.

The toner patterns (Sk, Sm, Sc, and Sy) formed on the intermediate transfer belt 8 pass through opposed positions with respect to the optical sensors 151 in association with the endless movement of the intermediate transfer belt 8. At this time, each of the optical sensors 151 receives the light of the amount corresponding to the toner adhesion amount per unit area for each toner patch of the gray-scale patterns.

Next, an adhesion amount in each toner patch of the color toner patterns is calculated from each output voltage of the optical sensors 151 when each color toner patch is detected and from an adhesion amount conversion algorithm, and imaging conditions are adjusted based on the calculated adhesion amount. More specifically, a function (y=ax+b) indicating a linear graph is calculated using regression analysis based on the result of detecting the toner adhesion amount in the toner patch and developing potential when each image of toner patches is formed. By substituting a target value of the image density in the function, each appropriate developing bias value is calculated, and the developing bias values for Y, M, C, and K are specified.

Stored in a memory is an imaging-condition data table in which tens of developing bias values and appropriate drum charge potentials corresponding thereto respectively are previously associated with each other. For the process units 6Y, 6M, 6C, and 6K, developing bias values nearest to specified developing bias values are respectively selected from the imaging-condition data table, and the drum charge potentials associated with the values are specified.

Figure 3:
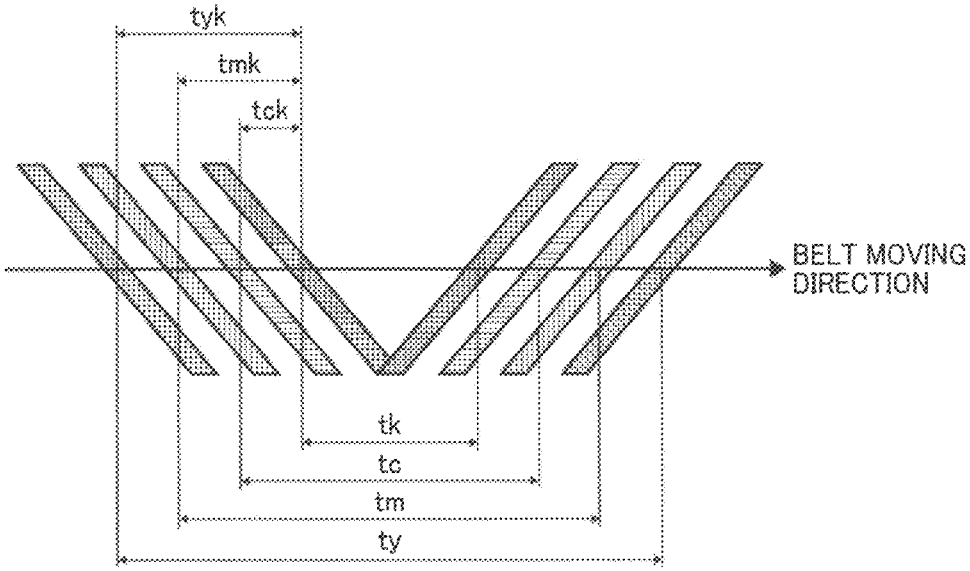
FIG. 3 is an enlarged schematic diagram representing a chevron patch formed on the intermediate transfer belt.

The printer is configured to execute also a color-deviation correction process each time the power is turned on or a predetermined number of sheets is printed. In the color-deviation correction process, a color-deviation detection image including Y, M, C, and K-toner images called a chevron patch PV as shown in FIG. 3 is formed on one end portion and the other end portion of the intermediate transfer belt 8 in its width direction. As shown in FIG. 3, the chevron patch PV is a line pattern group aligning the Y, M, C, and K-toner images at a predetermined pitch in a belt moving direction being a sub-scanning direction, in each position angled by about 45° from the main scanning direction. The adhesion amount of the chevron patch PV is about 0.3 mg/cm$^2$.

By detecting the color toner images in the chevron patches PV respectively formed on both end portions of the intermediate transfer belt 8 in the width direction, positions of the color toner images in the main scanning direction (axial direction of the photosensitive element), positions thereof in the sub-scanning direction (belt moving direction), a magnification error in the main scanning direction, and a skew from the main scanning direction are detected respectively. The main scanning direction mentioned here indicates a direction to which the laser light is moving along the surface of the photosensitive element in association with its reflection by a polygon mirror. Detection time differences between the Y, M, and C-toner images in the chevron patch PV and the K-toner image therein are read by the optical sensors 151, respectively. In FIG. 3, the vertical direction on the plane of paper corresponds to the main scanning direction. The Y, M, C, and K-toner images are aligned from the left side, and then the K, C, M, and Y-toner images are further aligned in such a manner that their positions are differently located by 90° from the above-mentioned images. Each deviation amount of the color toner images in the sub-scanning direction or each registration deviation amount is determined based on each difference between actually measured values of detection time differences tyk, tmk, and tck from K being a reference color and their theoretical values. Based on each registration deviation amount, an optical-writing start timing for the photosensitive element 1 is corrected at every other facet of a polygon mirror of an optical writing unit (not shown), or one scanning line pitch as one unit, and each registration deviation of the color toner images is reduced. In addition, based on the difference between deviation amounts in the sub-scanning direction between the both end portions, each skew of the color toner images from the main scanning direction is determined. Based on the results, surface-tilt correction of an optical system reflective mirror is performed, to reduce each skew deviation of the color toner images. As explained above, a process for correcting the optical-writing start timing and surface tilt and reducing the registration deviation and the skew deviation based on a timing at which each toner image in the chevron patch PV is detected is the color-deviation correction process. The color-deviation correction process allows prevention of color deviation of an image, due to temporal displacement of positions where the color toner images are formed, with respect to the intermediate transfer belt 8 caused by temperature change or the like.

Moreover, when an image forming operation of a low image area is continued, old toner remaining in the developing device for a long time is increased, and toner charge property is thereby degraded. Therefore, if this toner is used for image formation, image quality is degraded (decrease of developing capability, decrease of transfer property). There is provided a refresh mode in which such old toner is discharged to each non-image area of the photosensitive elements 1 at a fixed timing so that the old toner is prevented from being accumulated in the developing device, and after the discharge, new toner is supplied to the developing device in which toner concentration has decreased, to refresh the developing device.

The controller (not shown) stores therein amounts of toner consumptions of the developing devices 5Y, 5M, 5C, and 5K and operating times of the developing devices 5Y, 5M, 5C, and 5K, checks, at a predetermined timing, the developing devices whether each amount of toner consumption is a threshold or less for an operating time of the developing device in a predetermined period, and executes the refresh mode to the developing device whose toner consumption amount is the threshold or less.

When the refresh mode is executed, a toner consumption pattern is created in an non-image forming area on the photosensitive element corresponding to a space between sheets of paper, and is transferred to the intermediate transfer belt 8. The adhesion amount of the toner consumption pattern is determined based on the toner consumption amount for the operating time of the developing device in the predetermined period, and a maximum adhesion amount per unit area may become about 1.0 mg/cm$^2$. As a result of measuring the toner Q/d distribution of the toner consumption pattern transferred to the intermediate transfer belt 8, the polarities are nearly the normal charging polarities.

The gray-scale patterns for the colors, the chevron patch, and the toner consumption pattern formed on the intermediate transfer belt 8 are collected by the belt cleaning device 100. At this time, the belt cleaning device 100 has to remove a massive amount of toner from the intermediate transfer belt 8. However, a cleaning device provided with the conventional polarity control unit and brush roller and a cleaning device provided with a brush roller for removing toner having the positive polarity and a brush roller for removing toner having the negative polarity could not remove, at one time, the un-transferred toner image such as the gray-scale patterns for the colors, the chevron patch, and the toner consumption pattern. In this case, the toner which cannot be perfectly cleaned remaining on the intermediate transfer belt 8 is transferred to the recording paper at the time of next printing operation, which may cause an abnormal image.

Therefore, the belt cleaning device 100 of the printer is configured so as to be capable of removing the un-transferred toner images such as the gray-scale patterns of the colors, the chevron patch, and the toner consumption pattern at one time. It will be specifically explained below.

Figure 4:
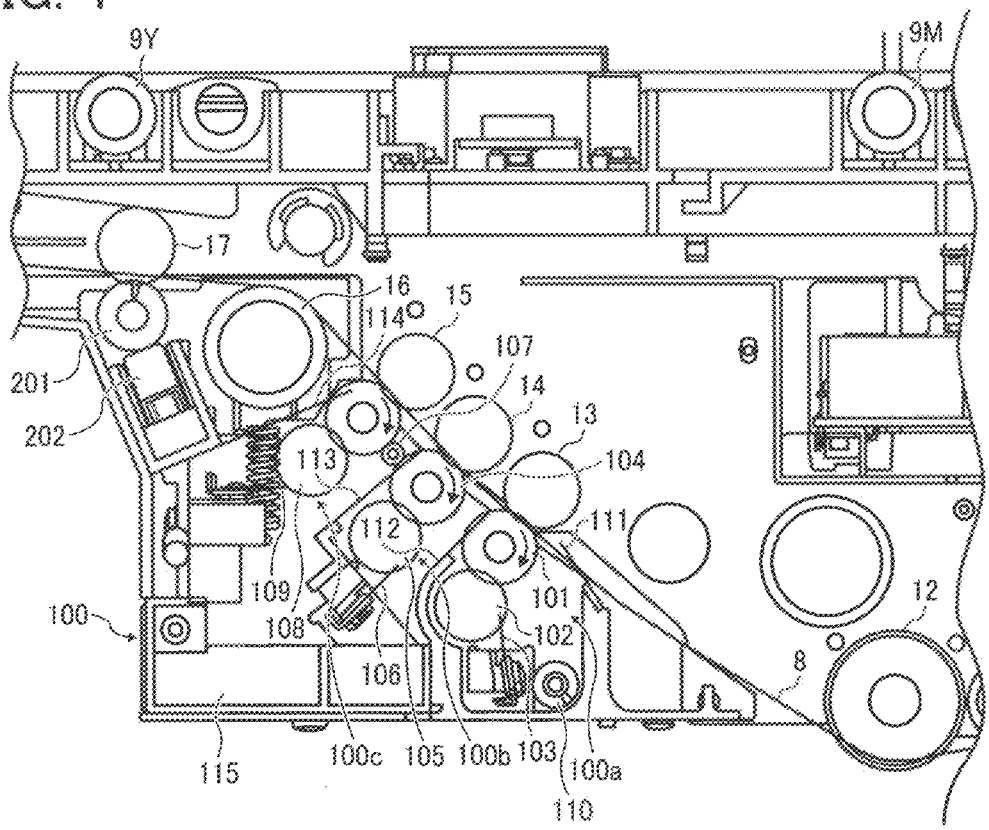
FIG. 4 is an enlarged configuration diagram representing an enlarged belt cleaning device of the printer and surroundings thereof.
Figure 5:
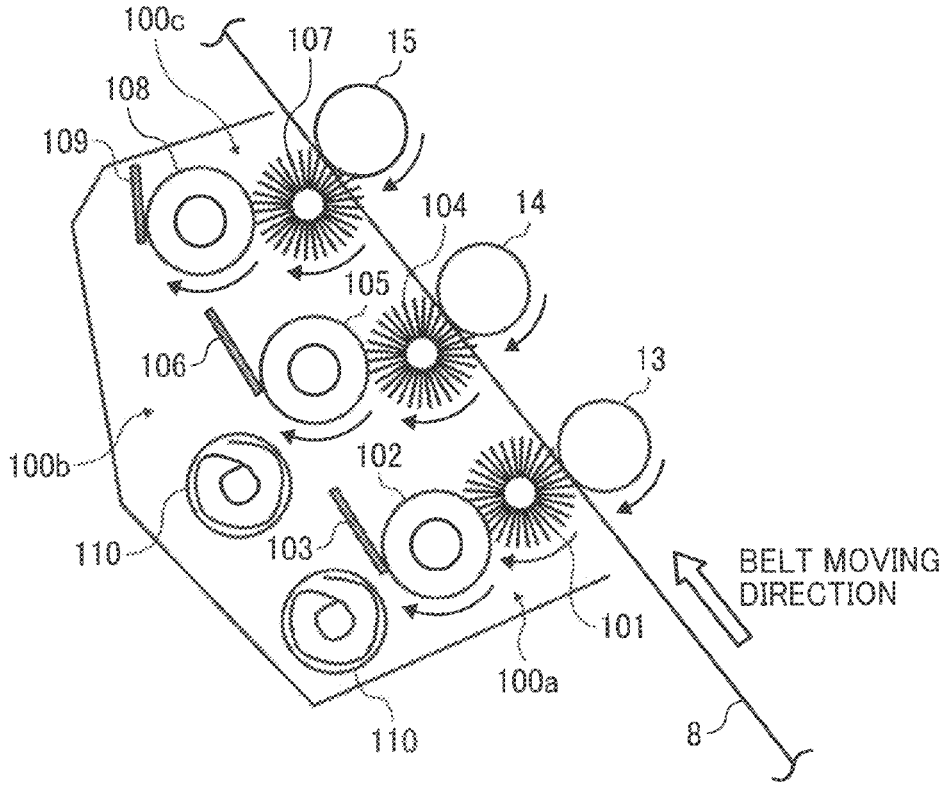
FIG. 5 is a schematic configuration diagram representing a main portion of the belt cleaning device.

FIG. 4 is an enlarged configuration diagram representing enlarged belt cleaning device 100 and surroundings thereof being characteristic points of the printer. FIG. 5 is a schematic configuration diagram representing a main portion of the belt cleaning device 100.

In FIGS. 4 and 5, the belt cleaning device 100 includes a pre-cleaning unit 100*a* for roughly removing un-transferred toner image on the intermediate transfer belt 8, a polarity control unit 100*b* for controlling the polarity of oppositely charged toner charged to the polarity (positive polarity) opposite to the normal charge polarity (negative polarity) on the intermediate transfer belt 8 to the normal charge polarity, and a normally-charged-toner cleaning unit 100*c* for removing normally charged toner charged to the normal charge polarity on the intermediate transfer belt 8.

The pre-cleaning unit 100*a* includes a pre-cleaning brush roller 101 being a pre-cleaning member. The pre-cleaning unit 100*a* also includes a pre-collecting roller 102 being a pre-collecting member for collecting toner adhering to the pre-cleaning brush roller 101, and a pre-scraping blade 103 being a pre-scraping member for being in contact with the pre-collecting roller 102 and scraping off the toner from the surface of the roller.

Because almost all of the toner particles forming the un-transferred toner image are charged to the normal charge polarity (negative polarity), a voltage having a polarity (positive polarity) opposite to the normal charge polarity is applied to the pre-cleaning brush roller 101, and the normally charged toner on the intermediate transfer belt 8 is thereby electrostatically removed. Applied to the pre-collecting roller 102 is a voltage having the positive polarity larger than that of the pre-cleaning brush roller 101. In the belt cleaning device 100, the voltage to be applied to the pre-cleaning brush roller 101, the biting depth to the intermediate transfer belt 8, the linear velocity, and the like are set so that 90% of the un-transferred toner image is removed by the pre-cleaning brush roller 101.

The pre-cleaning unit 100*a* is provided with a conveying screw 110 being a conveying unit for conveying toner to a waste toner tank (not shown) provided in an image forming apparatus body.

The polarity control unit 100*b* is disposed on the downstream side of the pre-cleaning unit 100*a* in the moving direction of the intermediate transfer belt 8, and includes a polarity-control brush roller 104 being a polarity control unit for applying an electric charge having a negative polarity to the oppositely charged toner charged to the polarity (positive polarity) opposite to the normal charge polarity (negative polarity) of toner and controlling the polarity to the normal charge polarity (negative polarity). The polarity-control brush roller 104 also has a function as an oppositely-charged-toner cleaning member for collecting the oppositely charged toner. The polarity control unit 100*b* also includes an oppositely-charged-toner collecting roller 105 being an oppositely-charged-toner collecting member for collecting a small amount of oppositely charged toner adhering to the polarity-control brush roller 104, and an oppositely-charged-toner scraping blade 106 being an oppositely-charged-toner scraping member for being in contact with the oppositely-charged-toner collecting roller 105 and scraping off the oppositely charged toner from the surface of the roller. A voltage having a negative polarity is applied to the polarity-control brush roller 104, and a voltage having a negative polarity larger than that of the polarity-control brush roller 104 is applied to the oppositely-charged-toner collecting roller 105.

The normally-charged-toner cleaning unit 100*c* is disposed on the downstream side of the polarity control unit 100*b* in the moving direction of the intermediate transfer belt 8, and includes a normally-charged-toner cleaning brush roller 107 being a normally-charged-toner cleaning member for electrostatically removing the normally charged toner charged to the normal charge polarity. The normally-charged-toner cleaning unit 100*c* also includes a normally-charged-toner collecting roller 108 being a normally-charged-toner collecting member for collecting normally charged toner adhering to the normally-charged-toner cleaning brush roller 107, and a normally-charged-toner scraping blade 109 being a normally-charged-toner scraping member for being in contact with the normally-charged-toner collecting roller 108 and scraping off the normally charged toner from the surface of the roller. A voltage having a positive polarity is applied to the normally-charged-toner cleaning brush roller 107, and a voltage having a positive polarity larger than that of the normally-charged-toner cleaning brush roller 107 is applied to the normally-charged-toner collecting roller 108.

As shown in FIG. 4, the pre-cleaning unit 100*a* and the polarity control unit 100*b* are separated from each other by a first insulating seal member 112. The first insulating seal member 112 is in contact with the pre-cleaning brush roller 101. By separating the pre-cleaning unit 100*a* and the polarity control unit 100*b* using the first insulating seal member 112, it is possible to prevent an electric discharge from occurring between the pre-cleaning brush roller 101 and the polarity-control brush roller 104, and to prevent the toner having being removed by the polarity control unit 100*b* from adhering again to the pre-cleaning brush.

The polarity control unit 100*b* and the normally-charged-toner cleaning unit 100*c* are separated from each other by a second insulating seal member 113. The second insulating seal member 113 is in contact with the polarity-control brush roller 104. By separating the pre-cleaning unit 100*a* and the polarity control unit 100*b* using the second insulating seal member 113, it is possible to prevent an electric discharge from occurring between the polarity-control brush roller 104 and the normally-charged-toner cleaning brush roller 107, and to prevent the toner having being removed by the normally-charged-toner cleaning unit 100*c* from adhering again to the polarity-control brush roller 104.

Provided at an exit portion of the belt cleaning device 100 is a third insulating seal member 114 in contact with the normally-charged-toner cleaning brush roller 107. Thus, it is possible to prevent occurrence of an electric discharge between the normally-charged-toner cleaning brush roller 107 and the tension roller 16.

The belt cleaning device 100 is provided with an entrance seal 111 and a waste toner case 115. The waste toner case 115 stores therein toner removed by the polarity control unit 100*b* and the normally-charged-toner cleaning unit 100*c*. The waste toner case 115 is removably attached to the belt cleaning device 100, so that the waste toner case 115 is removed from the belt cleaning device 100 at the time of maintenance and the toner stored in the waste toner case 115 can be removed therefrom.

The belt cleaning device 100 is configured to store the toner removed by the polarity control unit 100*b* and the normally-charged-toner cleaning unit 100*c* in the waste toner case 115, however, the configuration is not limited to the above. For example, by providing a conveying member for conveying toner to the conveying screw 110 in the bottom portion of the belt cleaning device 100 or by providing the bottom portion as an inclined surface toward the conveying screw 110, the toner removed by the polarity control unit 100*b* and the normally-charged-toner cleaning unit 100*c* may also be conveyed by the conveying screw 110 to a waste toner tank (not shown) provided in the image forming apparatus body. In addition to the conveying screw, there may be provided a second conveying screw for conveying the toner removed by the polarity control unit 100*b* and the normally-charged-toner cleaning unit 100*c* to the waste toner tank (not shown) provided in the image forming apparatus body.

Each of the cleaning brush rollers 101, 104, and 107 is provided with a rotatably supported rotating shaft member which is made of metal and a brush portion with a plurality of fibers implanted in the circumferential surface of the rotating shaft member, and its outer diameter is ϕ 15 to 16 mm. The fiber has a core-in-sheath structure that is a two-layered structure in which its inside is made of a conductive material such as conductive carbon and its surface portion is made of an insulating material such as polyester. With this feature, a potential of the core is nearly the same as the voltage applied to the cleaning brush roller, so that the toner can be electrostatically attracted to the fiber surface. As a result, the toner on the intermediate transfer belt 8 is caused to electrostatically adhere to the brush fibers by the action of the voltage applied to the brush roller. In addition, the brush fibers of the cleaning brush rollers 101, 104, and 107 may be made only of conductive fibers. The fibers may also be made of so-called slant fibers implanted so as to be slanted with respect to a normal direction of the rotating shaft member. The brush fibers of the pre-cleaning brush roller 101 and the normally-charged-toner cleaning brush roller 107 have the core-in-sheath structure, and the brush fibers of the polarity-control brush roller 104 may be made only of the conductive fibers. If the brush fibers of polarity-control brush roller 104 are made only of the conductive fibers, then an electric charge is easily injected from the polarity-control brush roller 104 into the toner. Therefore, the polarity-control brush roller 104 can cause the toner particles on the intermediate transfer belt 8 to be satisfactorily changed to the negative polarity. Meanwhile, if the brush fibers of the cleaning brush roller 101 and the normally-charged-toner cleaning brush roller 107 have the core-in-sheath structure, then the charge injection into the toner can thereby be suppressed, so that the toner on the intermediate transfer belt 8 is prevented from being charged to the positive polarity. With this feature, the pre-cleaning brush roller 101 and the normally-charged-toner cleaning brush roller 107 can prevent occurrence of the toner incapable of being electrostatically removed.

Moreover, the brush rollers 101, 104, and 107 are pressed onto the intermediate transfer belt 8 by 0.7 to 1.5 mm, and the brush is caused to rotate by the drive unit (not shown) at the contact portion so that the brush moves in the direction (counter direction) opposite to the moving direction of the intermediate transfer belt 8. By rotating the brush at the contact portion so as to be moved in the counter direction, the relative speed of the brush roller to the intermediate transfer belt 8 at the contact portion can be made faster. As a result, a contact probability of a certain portion of the intermediate transfer belt 8 with the brush increases in a period in which the certain portion of the intermediate transfer belt 8 passes through the contact range with the brush roller, and the toner can thereby be satisfactorily removed from the intermediate transfer belt 8.

The faster the relative speed of the brush roller to the intermediate transfer belt 8, the brush roller is degraded more quickly caused by wearing of the brush due to its slidable contact with the intermediate transfer belt 8 being the body to be cleaned. Moreover, the larger the biting depth of the brush roller to the intermediate transfer belt 8, the fibers become more quickly tilted. Based on these facts, by setting the relative speed of the brush roller to the intermediate transfer belt 8 to be slower and by setting the biting depth of the brush roller to the intermediate transfer belt 8 to be as small as possible, the life of the brush roller is increased. However, if the relative speed of the brush roller to the intermediate transfer belt 8 is set to be slower, then the contact probability of a certain portion of the intermediate transfer belt 8 with the brush fibers decreases in a period in which the certain portion of the intermediate transfer belt 8 passes through the contact range with the brush roller, and the cleaning property thereby decreases. Moreover, if the biting depth of the brush roller to the intermediate transfer belt 8 is decreased, then a contact area of the brush fiber with the intermediate transfer belt 8 decreases or a contact range of the intermediate transfer belt 8 with the brush roller decreases, which also results in lowering of cleaning property. Therefore, the relative speed of the brush roller to the intermediate transfer belt 8 cannot be made unnecessarily slow, or the biting depth of the brush roller to the intermediate transfer belt 8 cannot be made unnecessarily small.

As explained above, the cleaning device of the present embodiment is provided with the pre-cleaning unit 100*a*, and sets so that 90% of an un-transferred toner image can be removed by the pre-cleaning brush roller 101. Because of this, each amount of toner input to the polarity-control brush roller 104 and the normally-charged-toner cleaning brush roller 107 is less than that input to the pre-cleaning brush roller 101. Therefore, the small amount of toner is removed by the polarity-control brush roller 104 and the normally-charged-toner cleaning brush roller 107. Thus, even if each relative speed and each biting depth of the polarity-control brush roller 104 and the normally-charged-toner cleaning brush roller 107 are reduced to values less than these of the pre-cleaning brush roller 101, the toner can be satisfactorily cleaned off. Moreover, the polarity-control brush roller 104 changes the polarity of the toner on the intermediate transfer belt 8 to obtain normally charged toner through charge injection and electric discharge, and thus, the toner having the positive polarity removed by the polarity-control brush roller 104 is less than that by the normally-charged-toner cleaning brush roller 107. Accordingly, even if the relative speed and the biting depth of the polarity-control brush roller 104 are decreased to values less than these of the normally-charged-toner cleaning brush roller 107, the toner having the positive polarity can be satisfactorily cleaned off.

In this way, with the view of each amount of toner removed by the brush rollers 101, 104, and 107, the relative speeds of the brush rollers 101, 104, and 107 to the intermediate transfer belt in the belt cleaning device 100 according to the present embodiment are defined as follows. That is, the relative speed of the pre-cleaning brush roller 101>the relative speed of the normally-charged-toner cleaning brush roller 107>the relative speed of the polarity-control brush roller 104. In addition, the biting depths of the brush rollers 101, 104, and 107 to the intermediate transfer belt 8 are set as follows: pre-cleaning brush roller 101>normally-charged-toner cleaning brush roller 107>polarity-control brush roller 104.

One example will be shown. When a peripheral speed of the pre-cleaning brush roller 101 is set to the same as a linear speed of the intermediate transfer belt 8 and if the linear speed of the intermediate transfer belt 8 is 500 mm/s, then the relative speed of the pre-cleaning brush roller 101 to the intermediate transfer belt 8 is set to 1,000 mm/s. The number of revolutions of the pre-cleaning brush roller at this time is: $500*60/(15*\pi)=637$ rpm. The peripheral speed of the polarity-control brush roller 104 is set to 250 mm/s which is a half of the linear speed of the intermediate transfer belt 8, and the relative speed of the polarity-control brush roller 104 to the intermediate transfer belt 8 is set to 750 mm/s. The peripheral speed of the normally-charged-toner cleaning brush roller 107 is set to 350 mm/s, and the relative speed thereof to the intermediate transfer belt 8 is set to 850 mm/s. Each biting depth of the brush rollers to the intermediate transfer belt 8 is set as follows: the pre-cleaning brush roller 101: 1.5 mm, the polarity-control brush roller 104: 0.7 mm, and the normally-charged-toner cleaning brush roller 107: 1.0 mm. As for each relative speed and each biting depth of the brush rollers 101, 104, and 107 to the intermediate transfer belt 8, an optimal value changes depending on the system and toner or the like, and thus these values are not limited to the above values.

In this manner, by setting each relative speed of the polarity-control brush roller 104 and the normally-charged-toner cleaning brush roller 107 to the intermediate transfer belt 8 to be slower than the relative speed of the pre-cleaning brush roller 101 to the intermediate transfer belt 8, the wearing of the polarity-control brush roller 104 and the normally-charged-toner cleaning brush roller 107 is suppressed as compared with the case where each relative speed of the polarity-control brush roller 104 and the normally-charged-toner cleaning brush roller 107 to the intermediate transfer belt 8 is set to the same as the relative speed of the pre-cleaning brush roller 101 to the intermediate transfer belt 8. This allows the life of the polarity-control brush roller 104 and the normally-charged-toner cleaning brush roller 107 to be prolonged. Meanwhile, because each relative speed of the polarity-control brush roller 104 and the normally-charged-toner cleaning brush roller 107 to the intermediate transfer belt 8 is set to be slower than the relative speed of the pre-cleaning brush roller 101 to the intermediate transfer belt 8, each cleaning property of these rollers decreases more than that of the pre-cleaning brush roller 101. However, each amount of toner input to the polarity-control brush roller 104 and the normally-charged-toner cleaning brush roller 107 is less than that to the pre-cleaning brush roller 101. Therefore, even if the cleaning property of these rollers decreases more than that of the pre-cleaning brush roller 101, the oppositely charged toner can be satisfactorily removed by the polarity-control brush roller 104, and the normally charged toner can be satisfactorily removed by the normally-charged-toner cleaning brush roller 107.

Moreover, by setting the relative speed of the polarity-control brush roller 104 to the intermediate transfer belt 8 to be slower than the relative speed of the normally-charged-toner cleaning brush roller 107 to the intermediate transfer belt 8, the wearing of the polarity-control brush roller 104 can be suppressed as compared with the case where the relative speed of the polarity-control brush roller 104 to the intermediate transfer belt 8 is set to the same as the relative speed of the normally-charged-toner cleaning brush roller 107 to the intermediate transfer belt 8. This allows the life of the polarity-control brush roller 104 to be prolonged. Meanwhile, by setting the relative speed of the polarity-control brush roller 104 to the intermediate transfer belt 8 to be slower than the relative speed of the normally-charged-toner cleaning brush roller 107 to the intermediate transfer belt 8, the cleaning property of the polarity-control brush roller 104 decreases more than that of the normally-charged-toner cleaning brush roller 107. However, the amount of oppositely charged toner removed by the polarity-control brush roller 104 is less than the normally charged toner removed by the normally-charged-toner cleaning brush roller 107. Therefore, even if the cleaning property of the polarity-control brush roller 104 decreases more than that of the normally-charged-toner cleaning brush roller 107, the oppositely charged toner can be satisfactorily removed by the polarity-control brush roller 104.

By setting each biting depth of the polarity-control brush roller 104 and the normally-charged-toner cleaning brush roller 107 to the intermediate transfer belt 8 to be less than the biting depth of the pre-cleaning brush roller 101 to the intermediate transfer belt 8, the wearing of the polarity-control brush roller 104 and the normally-charged-toner cleaning brush roller 107 can be suppressed as compared with the case where each biting depth of the polarity-control brush roller 104 and the normally-charged-toner cleaning brush roller 107 to the intermediate transfer belt 8 is set to the same as the biting depth of the pre-cleaning brush roller 101 to the intermediate transfer belt 8. This allows the life of the polarity-control brush roller 104 and the normally-charged-toner cleaning brush roller 107 to be prolonged. Moreover, even if each biting depth of the polarity-control brush roller 104 and the normally-charged-toner cleaning brush roller 107 to the intermediate transfer belt 8 is made less than the biting depth of the pre-cleaning brush roller 101 to the intermediate transfer belt 8 and each cleaning property of these rollers thereby decreases more than that of the pre-cleaning brush roller 101, each amount of toner input to the polarity-control brush roller 104 and the normally-charged-toner cleaning brush roller 107 is less than that to the pre-cleaning brush roller 101. Therefore, even if the cleaning property of these rollers is decreased more than that of the pre-cleaning brush roller 101, the oppositely charged toner can be satisfactorily removed by the polarity-control brush roller 104, and the normally charged toner can be satisfactorily removed by the normally-charged-toner cleaning brush roller 107.

By setting the biting depth of the polarity-control brush roller 104 to the intermediate transfer belt 8 to be less than the biting depth of the normally-charged-toner cleaning brush roller 107 to the intermediate transfer belt 8, the wearing of the polarity-control brush roller 104 can be suppressed as compared with the case where the biting depth of the polarity-control brush roller 104 to the intermediate transfer belt 8 is set to the same as the biting depth of the normally-charged-toner cleaning brush roller 107 to the intermediate transfer belt 8. This allows the life of the polarity-control brush roller 104 to be prolonged. Meanwhile, by setting the biting depth of the polarity-control brush roller 104 to the intermediate transfer belt 8 to be less than the biting depth of the normally-charged-toner cleaning brush roller 107 to the intermediate transfer belt 8, the cleaning property of the polarity-control brush roller 104 decreases more than that of the normally-charged-toner cleaning brush roller 107. However, the amount of oppositely charged toner removed by the polarity-control brush roller 104 is less than the normally charged toner removed by the normally-charged-toner cleaning brush roller 107. Therefore, even if the cleaning property of the polarity-control brush roller 104 decreases more than that of the normally-charged-toner cleaning brush roller 107, the oppositely charged toner can be satisfactorily removed by the polarity-control brush roller 104.

The main function of the polarity-control brush roller 104 is to make the polarity of the toner on the intermediate transfer belt 8 the same as the normal charge polarity. Therefore, the polarity-control brush roller 104 is set to move at a constant velocity at its contact portion with the intermediate transfer belt 8 in the same direction as the intermediate transfer belt 8, and the relative speed thereof to the intermediate transfer belt 8 may be set to zero, or the biting depth may be set to zero. In this case, however, the function of removing the oppositely charged toner decreases, and the amount of toner input to the normally-charged-toner cleaning brush roller 107 increases. As a result, the biting depth and the relative speed of the normally-charged-toner cleaning brush roller 107 have to be increased to some extent to enhance the cleaning property, and this causes the load to the normally-charged-toner cleaning brush roller 107 to become heavy. As another method for enhancing the cleaning property, there is a method for increasing a bias applied to the normally-charged-toner cleaning brush roller 107. In this case, however, the bias easily leaks in peripheral components, and to prevent the leakage, it is necessary to separate the normally-charged-toner cleaning brush roller 107 from the peripheral components, and this leads to upsizing of the cleaning device, which is not preferable. Therefore, it is preferable to remove the oppositely charged toner by slightly increasing the relative speed and the biting depth of the polarity-control brush roller 104 to the intermediate transfer belt 8. As explained above, the oppositely charged toner is removed by the polarity-control brush roller 104, and the amount of toner input to the normally-charged-toner cleaning brush roller 107 thereby decreases, and this allows the biting depth and the relative speed of the normally-charged-toner cleaning brush roller 107 to be suppressed. As a result, the load to the normally-charged-toner cleaning brush roller 107 can be reduced, and the life of the normally-charged-toner cleaning brush roller 107 can be prolonged.

In the belt cleaning device 100, an SUS (stainless steel) roller is used as the collecting rollers 102, 105, and 108. The collecting rollers 102, 105, and 108 can be made of any material if they have a function of transferring the toner adhering to the brush roller from the brush to the collecting roller by each potential gradient between the fibers and the collecting roller. For example, as each of the collecting rollers 102, 105, and 108, there may be used a roller with a roller resistance set to log R=12 to 13Ω by covering a conductive core bar with a high-resistant elastic tube of several μm to 100 μm or by further applying insulation coating to the conductive core bar. By using the SUS roller as the collecting rollers 102, 105, and 108, there are such advantages that cost can be reduced, an applied voltage can be suppressed to a low value, and power saving can be achieved. Meanwhile, by setting the roller resistance to log R=12 to 13Ω, the charge injection into the toner can be suppressed at the time of collecting the toner to the collecting roller, and the polarity of the toner becomes the same as the polarity of the applied voltage of the collecting roller, so that the lowering of a toner collecting capability can be prevented.

Each of the collecting rollers 102, 105, and 108 is caused to rotate so that the surface thereof at the contact portion with each of the corresponding brush rollers 101, 104, and 107 moves in the direction (counter direction) opposite to the brush moving direction. With this feature, a moving distance of the brush along the surface of the collecting roller can be made longer in a period in which the brush of the brush roller passes through its contact portion with the collecting roller, and the toner collecting capability for the collecting roller can be increased. Each relative speed of the collecting rollers to the corresponding brush rollers and each biting depth thereof to the corresponding brush rollers are set for each collecting roller, similarly to the brush roller, based on the amount of collected toner. If the relative speed of the collecting roller to the brush roller is faster, the moving distance of the brush along the surface of the collecting roller becomes longer, and the toner collecting capability thereby increases. However, if the relative speed is fast, the collecting roller is quickly worn and becomes increasingly degraded. If the biting depth of the collecting roller to the brush roller is larger, the contact area of the brush with the collecting roller increases, and the toner collecting capability also increases. However, if the biting depth is large, the fibers of the brush are quickly tilted, and the brush roller and the collecting roller are quickly worn, which causes the rollers to be increasingly degraded. Therefore, the relative speed and the biting depth of the collecting roller are preferably low in order to prolong the life of the brush roller and the collecting roller.

As explained above, the cleaning device of the present embodiment is provided with the pre-cleaning unit 100*a*, and sets so that 90% of the un-transferred toner image can be removed by the pre-cleaning brush roller 101. Because of this, each amount of toner input to the polarity-control brush roller 104 and the normally-charged-toner cleaning brush roller 107 is less than that input to the pre-cleaning brush roller 101. Therefore, the small amount of toner adheres to the polarity-control brush roller 104 and the normally-charged-toner cleaning brush roller 107. Thus, even if each relative speed and each biting depth of the oppositely-charged-toner collecting roller 105 and the normally-charged-toner collecting roller 108 are reduced to values less than these of the pre-cleaning brush roller 101, the toner can be satisfactorily cleaned off from the brush. Therefore, the toner hardly remains on the polarity-control brush roller 104 and the normally-charged-toner cleaning brush roller 107 without being collected by the collecting roller. Thus, the cleaning property of the polarity-control brush roller 104 is prevented from lowering, and the oppositely charged toner can thereby be satisfactorily removed from the intermediate transfer belt 8. Likewise, the cleaning property of the normally-charged-toner cleaning brush roller 107 is prevented from lowering, and the normally charged toner can thereby be satisfactorily removed from the intermediate transfer belt 8. In addition, the polarity-control brush roller 104 controls the polarity of the toner on the intermediate transfer belt 8 to the negative polarity being the normal charge polarity, and thus, the amount of oppositely charged (positive polarity) toner adhering to the polarity-control brush roller 104 is less than the amount of toner adhering to the normally-charged-toner cleaning brush roller 107. Therefore, even if the relative speed and the biting depth of the oppositely-charged-toner collecting roller 105 to the brush roller are values smaller than the relative speed and the biting depth of the normally-charged-toner collecting roller 108 thereto, the toner adhering to the polarity-control brush roller 104 can be satisfactorily collected. Meanwhile, because a large amount of toner adheres to the pre-cleaning brush roller 101, the pre-collecting roller 102 increases the collecting capability by increasing the biting depth to the pre-cleaning brush roller 101 and making the relative speed faster. With this feature, uncollected toner remaining on the pre-cleaning brush roller 101 without being collected by the pre-collecting roller 102 can be prevented. As a result, the lowering of the cleaning property of the pre-cleaning brush roller 101 caused by the remaining uncollected toner can be prevented.

In this way, with the view of each amount of toner collected by the collecting rollers, the relative speeds of the collecting rollers to the brush rollers in the belt cleaning device 100 according to the present embodiment are set as follows: pre-collecting roller 102>normally-charged-toner collecting roller 108>oppositely-charged-toner collecting roller 105. In addition, the biting depths of the collecting rollers to the brush rollers are set as follows: pre-collecting roller 102>normally-charged-toner collecting roller 108>oppositely-charged-toner collecting roller 105.

More specifically, the linear speed of the pre-collecting roller 102 was set to 500 mm/s which is the same as the linear speed of the pre-cleaning brush roller 101, and the relative speed thereof to the pre-cleaning brush roller 101 was set to 1,000 mm/s. In addition, the biting depth of the pre-collecting roller 102 to the pre-cleaning brush roller 101 was set to 1.5 mm. The linear speed of the oppositely-charged-toner collecting roller 105 was set to 125 mm/s which is a half of the linear speed of the polarity-control brush roller 104, and the relative speed thereof to the polarity-control brush roller 104 was set to 375 mm/s. The biting depth of the oppositely-charged-toner collecting roller 105 to the polarity-control brush roller 104 was set to 0.7 mm. The linear speed of the normally-charged-toner collecting roller 108 was set to 200 mm/s, and the relative speed thereof to the normally-charged-toner cleaning brush roller 107 was set to 550 mm/s. The biting depth of the normally-charged-toner collecting roller 108 to the normally-charged-toner cleaning brush roller was set to 1 mm. As for each relative speed and each biting depth of the collecting rollers, an optimal value changes depending on the system and toner, and thus these values are not limited to the above values.

As explained above, each relative speed of the normally-charged-toner collecting roller 108 and the oppositely-charged-toner collecting roller 105 to the brush roller is set to be slower than the relative speed of the pre-collecting roller 102. Therefore, the wearing of the polarity-control brush roller 104 and the normally-charged-toner cleaning brush roller 107 is suppressed, and the life of the polarity-control brush roller 104 and the normally-charged-toner cleaning brush roller 107 can thereby be prolonged. The wearing of the oppositely-charged-toner collecting roller 105 and the normally-charged-toner collecting roller 108 can also be suppressed, and the life of the oppositely-charged-toner collecting roller 105 and the normally-charged-toner collecting roller 108 can be prolonged. In addition, the linear speed of the oppositely-charged-toner collecting roller 105 is reduced and the relative speed thereof to the polarity-control brush roller 104 is made slow. Therefore, the wearing of the oppositely-charged-toner scraping blade 106 can be suppressed, and the life of the oppositely-charged-toner scraping blade 106 can also be prolonged. The life of the normally-charged-toner scraping blade 109 can also be prolonged for the same reason as above.

Next, the brush rollers 101, 104, and 107 and the cleaning opposed rollers 13, 14, and 15 are aluminum rollers of ϕ 14 mm, and drivenly rotate by frictional force between the intermediate transfer belt 8 and each of their own surfaces. The cleaning opposed rollers 13, 14, and 15 are grounded.

The conditions of the brush rollers 101, 104, and 107 are as follows.

Brush material: conductive polyester (conductive carbon is included inside a fiber, and the surface of the fiber is polyester, or so-called core-in-sheath structure)
Brush resistance: $10^{6\ to\ 8}\Omega$
Applied voltage V to rotating shaft member
Pre-cleaning brush roller 101: +1600 to 2000 V
Polarity-control brush roller 104: −2000 to −2400 V
Normally-charged-toner cleaning brush roller 107: 800 to 1200 V
Implantation density of brush fibers: 100,000 fibers/inch$^2$
Brush fiber diameter: about 25 to 35 μm
Fiber-tilting treatment for tips of brush fibers: provided
Brush diameter ϕ: 15 to 16 mm An applied voltage to the pre-cleaning brush roller 101 is set so that satisfactory cleaning property can be obtained when an un-transferred toner image such that a large amount of toner adheres to the intermediate transfer belt 8 is input to the pre-cleaning brush roller 101. Moreover, an applied voltage to the polarity-control brush roller 104 is set to be slightly high so that an electric charge is injected into the toner on the intermediate transfer belt 8. The implantation density of brush fibers, the brush resistance, the fiber diameter, the applied voltage, the types of fiber, and the biting depth of the brush fibers can be optimized by the system, and therefore, these values are not limited to the above values. As a type of usable fiber, there are nylon, acrylic, polyester, and the like.

The conditions of the collecting rollers 102, 105, and 108 are as follows.

Core-bar material of collecting roller: SUS
Applied voltage to core bar of collecting roller:
Pre-collecting roller 102: 2000 to 2400 V
Polarity-control collecting roller: −2400 to −2800 V
Normally-charged-toner collecting roller 108: +1000 to +1400 V The material of the collecting roller, the biting depth of the brush fibers, and the applied voltage can be optimized by the system, and therefore, these values are not limited to the above values.

The conditions of the scraping blades 103, 106, and 109 are as follows.

Blade contact angle: 20°
Blade thickness: 0.1 mm
Biting depth of blade to collecting roller: 1.0 mm The blade contact angle, the blade thickness, the biting depth to the collecting roller can be optimized by the system, and therefore, these values are not limited to the above values.

Next, an cleaning operation of the belt cleaning device 100 will be explained.

As shown in FIG. 4, the residual toner after transfer and the un-transferred toner image having passed through the secondary transfer portion pass the contact portion of the entrance seal 111, and are transferred to the position of the pre-cleaning brush roller 101 through the rotation of the intermediate transfer belt 8. Applied to the pre-cleaning brush roller 101 is a voltage having a polarity (positive polarity) opposite to the normal charge polarity of the toner, and the toner charged to the negative polarity on the intermediate transfer belt 8 is electrostatically attracted and is moved to the pre-cleaning brush roller 101 by means of an electric field formed by a potential difference between the intermediate transfer belt 8 and the surface potential of the pre-cleaning brush roller 101. The toner having the negative polarity moved to the pre-cleaning brush roller 101 is transferred to the contact position with the pre-collecting roller 102 applied with the voltage having the positive polarity whose value is larger than the pre-cleaning brush roller 101. Then, the toner having moved onto the pre-cleaning brush roller 101 is electrostatically attracted and is moved onto the pre-collecting roller 102 by means of an electric field formed by a potential difference between the surface potential of the pre-cleaning brush roller 101 and the surface potential of the pre-collecting roller 102. The toner with the negative polarity having moved to the pre-collecting roller 102 is scraped off from the surface of the collecting roller by the pre-scraping blade 103. The toner scraped off by the pre-scraping blade 103 is ejected to the outside of the device by the conveying screw 110.

The toner having the negative polarity and the toner having the positive polarity of the un-transferred toner image on the intermediate transfer belt 8 which cannot be removed by the pre-cleaning brush roller 101, and the residual toner after transfer having the positive polarity are transferred to the position of the polarity-control brush roller 104. Applied to the polarity-control brush roller 104 is a voltage having the same polarity (negative polarity) as the normal charge polarity of the toner, and the polarity of the toner on the intermediate transfer belt 8 is made to the negative polarity through the charge injection and the electric discharge. At the same time, the oppositely charged toner charged to the positive polarity on the intermediate transfer belt 8 is electrostatically attracted and is moved to the polarity-control brush roller 104 by means of an electric field formed by a potential difference between surface potentials of the intermediate transfer belt 8 and the polarity-control brush roller 104. The oppositely charged toner having the positive polarity moved to the polarity-control brush roller 104 is transferred to the contact position with the oppositely-charged-toner collecting roller 105 applied with the voltage having the negative polarity whose value is larger than the polarity-control brush roller 104. Then, the oppositely charged toner having moved onto the polarity-control brush roller 104 is electrostatically attracted and is moved onto the oppositely-charged-toner collecting roller 105 by means of an electric field formed by a potential difference between the surface potential of the polarity-control brush roller 104 and the surface potential of the oppositely-charged-toner collecting roller 105. The oppositely charged toner with the positive polarity having moved to the oppositely-charged-toner collecting roller 105 is scraped off from the surface of the collecting roller by the oppositely-charged-toner scraping blade 106.

Next, the toner whose polarity having shifted to the negative polarity by the polarity-control brush roller 104 and the toner having the negative polarity incapable of being removed by the pre-cleaning brush roller 101 are transferred to the normally-charged-toner cleaning brush roller 107. The polarity of the toner transferred to the normally-charged-toner cleaning brush roller 107 is controlled to the negative polarity by the polarity-control brush roller 104. In addition, nearly all of the toner particles on the intermediate transfer belt 8 are removed by the pre-cleaning brush roller 101 and the polarity-control brush roller 104. Therefore, a small amount of toner is transferred to the normally-charged-toner cleaning brush roller 107. The small amount of toner, on the intermediate transfer belt 8, whose polarity is changed to the negative polarity and which is transferred to the normally-charged-toner cleaning brush roller 107, electrostatically adheres to the normally-charged-toner cleaning brush roller 107 applied with a voltage having a polarity (positive polarity) opposite to the normal charge polarity of the toner, is collected by the normally-charged-toner collecting roller 108, and is scraped off from the normally-charged-toner collecting roller 108 by the normally-charged-toner scraping blade 109.

As explained above, according to the belt cleaning device 100, by providing the pre-cleaning brush roller 101, the toner having the negative polarity, which occupies almost all of the un-transferred toner image, is roughly removed by the pre-cleaning brush roller 101. This allows reduction of the amount of toner input to the polarity-control brush roller 104 and the normally-charged-toner cleaning brush roller 107. The toner on the intermediate transfer belt 8 to be transferred to the normally-charged-toner cleaning brush roller 107 provided on the down-most stream side in the belt moving direction is not removed by the pre-cleaning brush roller 101 and the polarity-control brush roller 104, and thus, the amount of toner is very small. Besides, the toner on the intermediate transfer belt is toner whose polarity is made to the negative polarity by the polarity-control brush roller 104. Therefore, the remaining toner can be satisfactorily removed by the normally-charged-toner cleaning brush roller 107. In this manner, even if the un-transferred toner image such that a large amount of toner adheres to the intermediate transfer belt 8, the toner can be satisfactorily removed from the intermediate transfer belt 8.

The residual toner after transfer whose amount of toner is less than that of the un-transferred toner image can be satisfactorily removed by the three cleaning brush rollers 101, 104, and 107.

Next, a modification of the belt cleaning device 100 will be explained.

[First Modification}

Figure 6:
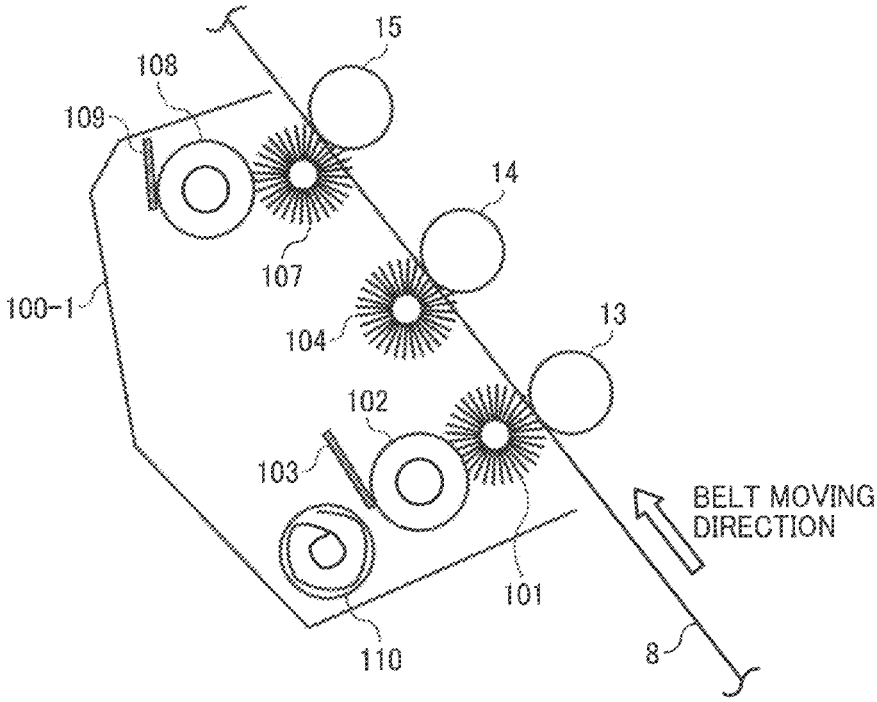
FIG. 6 is a schematic configuration diagram representing a main portion of a belt cleaning device according to a first modification.

FIG. 6 is a schematic configuration diagram of a belt cleaning device 100-1 according to a first modification.

The cleaning device 100-1 according to the first modification is configured in such a manner that the oppositely-charged-toner collecting roller 105 and the oppositely-charged-toner scraping blade 106 are omitted and the polarity control unit 100*b* does not remove the toner having the positive polarity on the intermediate transfer belt 8.

In the first modification, the toner having the positive polarity adhering to the polarity-control brush roller 104 is injected with the electric charge from the polarity-control brush roller 104 and the polarity is reversed to the negative polarity. Thereafter, the toner again adheres to the intermediate transfer belt 8 and is removed by the normally-charged-toner cleaning brush roller 107. In the configuration of the first modification, the amount of toner to be input to the normally-charged-toner cleaning brush roller 107 increases, however, because the oppositely-charged-toner collecting roller 105 and the oppositely-charged-toner scraping blade 106 are not provided, a layout is simplified, resulting in low cost.

Even with this configuration, the toner of the un-transferred toner image is roughly removed from the intermediate transfer belt 8 by the pre-cleaning brush roller 101, and the amount of toner to be transferred to the polarity control unit 100*b* becomes less. Therefore, the polarity control unit 100*b* can satisfactorily change the polarities of the toner particles on the intermediate transfer belt 8 to one of the polarities. As a result, the toner on the intermediate transfer belt 8 can be satisfactorily electrostatically removed by the cleaning brush roller provided on the downstream side of the polarity control unit 100*b*. Thus, even if the un-transferred toner image with a large amount of toner adhering thereto is input to the belt cleaning device 100-1, the toner can be excellently cleaned off.

In the belt cleaning device 100-1 of the first modification, the amount of toner input to the normally-charged-toner cleaning unit 100*c* is also small, and, therefore, by setting the relative speed and the biting depth of the normally-charged-toner cleaning brush roller 107 to the intermediate transfer belt 8 to be lower than these of the pre-cleaning brush roller 101, the load to the normally-charged-toner cleaning brush roller 107 can be reduced. With this feature, the life of the normally-charged-toner cleaning brush roller 107 can be prolonged as compared with the case where the relative speed and the biting depth thereof are set to the same as these of the pre-cleaning brush roller 101. In this configuration, the brush of the polarity-control brush roller 104 is caused to move at a constant speed in the same direction as the intermediate transfer belt 8 at its contact portion with the intermediate transfer belt 8, so that the relative speed thereof to the intermediate transfer belt 8 may be set to zero. This makes the polarity-control brush roller 104 not to slidably contact with the intermediate transfer belt 8, which enables the life of the polarity-control brush roller 104 to be prolonged.

Moreover, in the first modification, the amount of toner collected by the normally-charged-toner collecting roller 108 is also small, and thus, even if the relative speed of the normally-charged-toner collecting roller 108 to the normally-charged-toner cleaning brush roller 107 is set to be slower than the relative speed of the pre-collecting roller 102 to the pre-cleaning brush roller 101, or even if the biting depth of the normally-charged-toner collecting roller 108 to the normally-charged-toner cleaning brush roller 107 is made smaller than the biting depth of the pre-collecting roller 102 to the pre-cleaning brush roller 101, the toner can be satisfactorily colleted from the normally-charged-toner cleaning brush roller 107. This enables the life of the normally-charged-toner cleaning brush roller 107 and the life of the normally-charged-toner collecting roller 108 and of the normally-charged-toner scraping blade 109 to be prolonged.

In the first modification, the polarity-control brush roller 104 injects an electric charge having a negative polarity into the toner on the intermediate transfer belt 8. However, a unit for injecting an electric charge having a negative polarity into the toner on the intermediate transfer belt 8 may be a conductive blade, a corona charger, and the like. The charge polarity of toner is not made to the negative polarity, but is made to the positive polarity, and there may be configured to provide the cleaning brush roller applied with the voltage having a negative polarity on the downstream side of the polarity control unit 100*b* in the belt moving direction and to remove the toner, whose polarity is made to the positive polarity, on the intermediate transfer belt. Even with this configuration, the pre-cleaning brush roller 101 roughly removes the toner of the un-transferred toner image from the intermediate transfer belt 8, and the amount of toner to be transferred to the polarity control unit 100*b* becomes thereby less. Therefore, the polarity control unit 100*b* can make the polarity of the toner on the intermediate transfer belt 8 to one of the polarities. As a result, the toner on the intermediate transfer belt 8 can be satisfactorily and electrostatically removed by the cleaning brush roller provided on the downstream of the polarity control unit 100*b*. Accordingly, even if the un-transferred toner image with a large amount of toner adhering thereto is input to the belt cleaning device 100, the toner can be satisfactorily cleaned off.

The belt cleaning device 100 may also be configured to provide, instead of the polarity control unit 100*b*, an oppositely-charged-toner cleaning unit for removing the oppositely charged toner from the intermediate transfer belt 8 and not to perform control for changing the polarity of the toner on the intermediate transfer belt 8 to the negative polarity. In this case, because the amount of toner removed by the normally-charged-toner cleaning unit 100*c* decreases, the relative speed and the biting depth of the normally-charged-toner cleaning brush roller 107 to the intermediate transfer belt 8 can be decreased more than these of the belt cleaning device 100 according to the embodiment, and the life of the normally-charged-toner cleaning brush roller 107 can thereby be prolonged. In addition, because the amount of toner input to the normally-charged-toner cleaning unit 100*c* decreases, the amount of toner to be collected by the normally-charged-toner collecting roller 108 decreases. Therefore, even if the collecting capability is set to be lower, the toner can be successfully collected from the normally-charged-toner cleaning brush roller 107. Thus, the relative speed and the biting depth of the normally-charged-toner collecting roller 108 to the normally-charged-toner cleaning brush roller 107 can be decreased, and the life of the normally-charged-toner cleaning brush roller 107 and the normally-charged-toner collecting roller 108 can thereby be prolonged.

Furthermore, in the belt cleaning device 100, the voltage is applied to the collecting rollers 102, 105, and 108 and the cleaning brush rollers 101, 104, and 107, however, by using a metal roller for each of the collecting rollers 102, 105, and 108, the voltage may be applied only to the collecting rollers. In this case, a bias voltage slightly lower than a bias voltage applied to the collecting rollers is applied to the cleaning brush rollers, in the form of mediating the contact portions with the collecting rollers, caused by a voltage drop due to fiber resistance of the cleaning brush rollers, respectively. This forms a potential difference between each of the collecting rollers and each of the cleaning brush rollers, and the toner can be electrostatically transferred from the cleaning brush roller to the collecting roller due to a potential gradient in the direction of the collecting roller.

Next, toner particles most appropriately used in the printer will be explained.

As for the toner particles most appropriately used in the printer, those having a volume-average particle size of 3 to 6 μm are preferable in order to reproduce fine dots of 600 dpi or more. Toner particles in a range of 1.00 to 1.40 as a ratio (Dv/Dn) between a volume-average particle size (Dv) and a number-average particle size (Dn) are preferable. If the ratio (Dv/Dn) is closer to 1.00, this case indicates that the particle-size distribution is sharper. The toner particles having such a small particle size and narrow particle-size distribution allows a charge amount distribution of the toner particles to be uniform, a high-quality image with less background fogging to be obtained, and a transfer ratio in an electrostatic transfer system to be increased.

Figure 7:
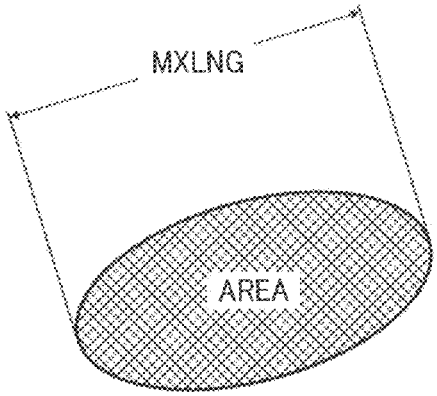
FIG. 7 is a schematic diagram for explaining a maximum diameter MXLNG and a planar area AREA of a projected image of a toner particle onto a two-dimensional plane.

A shape factor SF-1 of toner is preferably in a range of 100 to 150, and a shape factor SF-2 is preferably in a range of 100 to 180. FIG. 7 is a schematic diagram representing a shape of toner for explaining the shape factor SF-1. The shape factor SF-1 indicates the degree of sphericity of a toner shape, and is expressed by the following expression (1). The shape factor SF-1 is a value obtained by dividing the square of a maximum length MXLNG of a shape, which is obtained by projecting a toner particle onto a two-dimensional plane, by its graphics area AREA, and by multiplying the quotient by 100 π/4.

$$SF\text{-}1=\{(MXLNG)^2/AREA\}\times(100\pi)/4 \quad (1)$$

If the value of SF-1 is 100, the shape of toner becomes perfect sphericity, and if the value of SF-1 is greater, the shape becomes more irregular.

Figure 8:
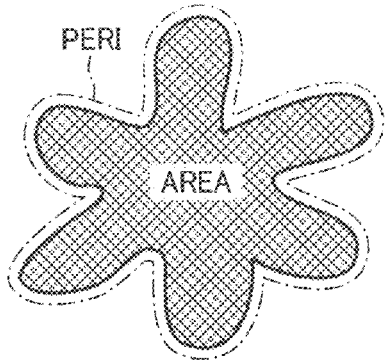
FIG. 8 is a schematic diagram for explaining a peripheral length PERI and a planar area AREA of the projected image of a toner particle onto the two-dimensional plane.

FIG. 8 is a schematic diagram of a shape of toner for explaining the shape factor SF-2. The shape factor SF-2 indicates the degree of irregularities of a toner shape, and is expressed by the following expression (2). The shape factor SF-2 is a value obtained by dividing the square of a peripheral length PERI of a graphic, which is obtained by projecting a toner particle onto a two-dimensional plane, by its graphic area AREA, and by multiplying the quotient by 100 π/4.

$$SF\text{-}2=\{(PERI)^2/AREA\}\times 100\,\pi/4 \quad (2)$$

If the value of SF-2 is 100, the surface of toner has no irregularities, and if the value of SF-2 is greater, the irregularities on the surface of the toner are more significant.

The shape factor was measured specifically by photographing a toner particle with a scanning electron microscope (S-800: manufactured by Hitachi Ltd.), putting the photograph into an image analyzer (LUSEX3: manufactured by Nireco Corp.), and analyzing and calculating it. If the shape of toner becomes more spherical, a contact between a toner particle and a toner particle or between a toner particle and the photosensitive element becomes a point contact, which causes an attracting force between the toner particles to get weak, and fluidity thereby becomes higher. The attracting force between the toner particle and the photosensitive element also gets weak, and as a result, the transfer ratio becomes high. If the SF-1 exceeds 150 and the SF-2 exceeds 180, the transfer ratio decreases, which is not preferable.

The toner most appropriately used in a color printer is obtained by allowing such a toner material solution that at least a polyester prepolymer having a functional group with nitrogen atoms, a polyester, a colorant, and a release agent are dispersed in an organic solvent, to undergo crosslinking reaction and/or elongation reaction in an aqueous medium. Materials of toner and a method of manufacturing the toner will be explained below.

(Polyester)

The polyester is obtained through a polycondensation reaction between a polyhydric alcohol compound and a polycarboxylic acid compound.

Examples of the polyhydric alcohol compound (PO) include dihydric alcohol (DIO) and trihydric or higher polyhydric alcohol (TO); and (DIO) alone or a mixture of (DIO) with a small amount of (TO) is preferable. Examples of dihydric alcohol (DIO) include alkylene glycol (e.g., ethylene glycol, 1,2-propylene glycol, 1,3-propylene glycol, 1,4-butanediol, and 1,6-hexanediol); alkylene ether glycol (e.g., diethylene glycol, triethylene glycol, dipropylene glycol, polyethylene glycol, polypropylene glycol, and polytetramethylene ether glycol); alicyclic diol (e.g., 1,4-cyclohexane dimethanol, and hydrogenated bisphenol A); bisphenols (e.g., bisphenol A, bisphenol F, and bisphenol S); adducts of alkylene oxide of the alicyclic diol (e.g., ethylene oxide, propylene oxide, and butylene oxide); and adducts of alkylene oxide of the bisphenols (e.g., ethylene oxide, propylene oxide, and butylene oxide). Among these, alkylene glycol having 2 to 12 carbon atoms and the adducts of alkylene oxides of the bisphenols are preferable. Particularly preferable are the adducts of alkylene oxides of the bisphenols, and a combination of the adducts of alkylene oxides of the bisphenols and alkylene glycol having 2 to 12 carbon atoms. Examples of trihydric or higher polyalcohol (TO) include trihydric to octahydric or higher polyhydric aliphatic alcohol (e.g., glycerol, trimethylolethane, trimethylolpropane, pentaerythritol, and sorbitol); trivalent or higher polyphenols (e.g., trisphenol PA, phenol novolak, and cresol novolak); and adducts of alkylene oxide of the trivalent or higher polyphenols.

Examples of a polycarboxylic acid (PC) include a divalent carboxylic acid (DIC) and a trivalent or higher polycarboxylic acid (TC), and (DIC) alone and a mixture of (DIC) with a small amount of (TC) are preferable. Examples of divalent carboxylic acid (DIC) include alkylene dicarboxylic acids (e.g., succinic acid, adipic acid, and sebacic acid); alkenylene dicarboxylic acid (e.g., maleic acid and fumaric acid); and aromatic dicarboxylic acid (e.g., phthalic acid, isophthalic acid, terephthalic acid, and naphthalene dicarboxylic acid). Among these, the alkenylene dicarboxylic acid having 4 to 20 carbon atoms and the aromatic dicarboxylic acid having 8 to 20 carbon atoms are preferred. Examples of trivalent or higher polycarboxylic acid (TC) include aromatic polycarboxylic acid having 9 to 20 carbon atoms (e.g., trimellitic acid and pyromellitic acid). The polycarboxylic acid (PC) may be reacted with polyhydric alcohol (PO) using acid anhydrides of these or lower alkyl esters (e.g., methyl ester, ethyl ester, and isopropyl ester).

A ratio between the polyhydric alcohol (PO) and the polycarboxylic acid (PC) is usually from 2/1 to 1/1, preferably from 1.5/1 to 1/1, and more preferably from 1.3/1 to 1.02/1, as an equivalent ratio of [OH]/[COOH] between a hydroxyl group [OH] and a carboxyl group [COOH]. A polycondensation reaction between the polyhydric alcohol (PO) and the polycarboxylic acid (PC) is performed by heating them to 150 to 280° C. in the presence of a known esterification catalyst such as tetrabutoxytitanate and dibutyltin oxide and by distilling water generated while pressure is reduced if required, and polyester having the hydroxyl group is obtained. A hydroxyl value of polyester is preferably 5 or higher, and an acid value of polyester is usually 1 to 30 and preferably 5 to 20. By causing polyester to have the acid value, it easily becomes negative electric and has excellent affinity between the recording paper and the toner when the toner is fixed on the recording paper, thus improving a low-temperature fixing property. However, if the acid value exceeds 30, this may degrade charge stability, especially, environmental fluctuation. In addition, its weight-average molecular weight is 10,000 to 400,000, preferably 20,000 to 200,000. If the weight-average molecular weight is less than 10,000, it is not preferable because of degradation of offset resistance. Meanwhile, if the weight-average molecular weight exceeds 400,000, it is also not preferable because of degradation of low-temperature fixing property.

Polyester adequately contains urea-modified polyester in addition to unmodified polyester obtained through the polycondensation reaction. The urea-modified polyester is obtained by reacting a carboxyl group or a hydroxyl group at an end of a polyester with a polyisocyanate compound (PIC), to obtain an isocyanate group-containing polyester prepolymer (A), and molecular chains are crosslinked and/or elongated through the reaction of the polyester prepolymer (A) and amines. Examples of a polyisocyanate compound (PIC) are aliphatic polyisocyanate (e.g., tetramethylene diisocyanate, hexamethylene diisocyanate, and 2,6-diisocyanate methyl caproate); alicyclic polyisocyanate (e.g., isophorone diisocyanate and cyclohexylmethane diisocyanate); aromatic diisocyanate (e.g., tolylene diisocyanate and diphenylmethane diisocyanate); aromatic aliphatic diisocyanate (e.g., α,α,α',α'-tetramethylxylylene diisocyanate); isocyanates; compounds formed by blocking these polyisocyanates by a phenol derivative, an oxime, and a caprolactam; and a combination of at least two of these. A ratio of the polyisocyanate compounds (PIC) is usually from 5/1 to 1/1, preferably from 4/1 to 1.2/1, and more preferably from 2.5/1 to 1.5/1, as an equivalent ratio of [NCO]/[OH] between an isocyanate group [NCO] and a hydroxyl group [OH] of a hydroxyl group-containing polyester. When [NCO]/[OH] exceeds 5/1, the low-temperature fixing property gets worse. In a case of using urea-modified polyester, the urea content in the ester becomes low when a molar ratio of [NCO] is less than 1/1, and hot offset resistance deteriorates. The content of the polyisocyanate compound (PIC) in the isocyanate group-containing polyester prepolymer (A) ranges usually from 0.5 to 40 wt %, preferably from 1 to 30 wt %, and more preferably from 2 to 20 wt %. If the content of the polyisocyanate compound is less than 0.5 wt %, the hot offset resistance deteriorates, and it is unfavorable from the viewpoint of compatibility of heat resistant preservability and low-temperature fixing property. Meanwhile, if the content of the polyisocyanate compound exceeds 40 wt %, the low-temperature fixing property gets worse. The number of isocyanate groups contained in one molecule of the isocyanate group-containing polyester prepolymer (A) is usually at least 1, preferably, an average of 1.5 to 3, and more preferably, an average of 1.8 to 2.5. If the isocyanate group per molecule is less than 1, then the molecular weight of the urea-modified polyester becomes low and the hot offset resistance deteriorates.

Next, amines (B) that are reacted with the polyester prepolymer (A) include a diamine compound (B1), a trivalent or higher polyamine compound (B2), amino alcohol (B3), amino mercaptan (B4), amino acid (B5), and the compounds (B6) in which B1 to B5 amino groups are blocked.

Examples of the diamine compound (B1) include aromatic diamine (e.g., phenylene diamine, diethyl toluene diamine, and 4,4'-diaminodiphenyl methane); alicyclic diamine (e.g., 4,4'-diamino-3,3'-dimethyldicyclohexylmethane, diamine cyclohexane, and isophorone diamine); and aliphatic diamine (e.g., ethylene diamine, tetramethylene diamine, and hexamethylene diamine). Examples of the trivalent or higher polyamine compound (B2) include diethylene triamine and triethylene tetramine. Examples of the amino alcohol (B3) include ethanolamine and hydroxyethylaniline. Examples of the amino mercaptan (B4) include aminoethyl mercaptan and aminopropyl mercaptan. Examples of the amino acid (B5) include aminopropionic acid and aminocaproic acid. Examples of the compound (B6), in which the amino groups of B1 to B5 are blocked, include a ketimine compound obtained from the amines of B1 to B5 and ketones (e.g., acetone, methyl ethyl ketone, and methyl isobutyl ketone), and an oxazolidine compound. The preferable amines among the amines (B) are B1 and a mixture of B1 with a small amount of B2.

A ratio of amines (B) is usually 1/2 to 2/1, preferably 1.5/1 to 1/1.5, and more preferably 1.2/1 to 1/1.2 as an equivalent ratio of [NCO]/[NHx] between an isocyanate group [NCO] in the isocyanate group-containing polyester prepolymer (A) and an amino group [NHx] in the amines (B). If [NCO]/[NHx] exceeds 2/1 or is less than 1/2, then the molecular weight of the urea-modified polyester becomes low, and the hot offset resistance deteriorates.

An urethane bond may be contained together with an urea bond in the urea-modified polyester. A molar ratio of the urea bond content and the urethane bond content ranges usually from 100/0 to 10/90, preferably from 80/20 to 20/80, and more preferably from 60/40 to 30/70. If the molar ratio of the urea bond is less than 10%, the hot offset resistance deteriorates.

The urea-modified polyester is manufactured by one shot method or the like. Polyhydric alcohol (PO) and polycarboxylic acid (PC) are heated to 150 to 280° C. in the presence of a known esterification catalyst such as tetrabutoxytitanate and dibutyltin oxide, and by distilling water generated while pressure is reduced if required, and polyester having the hydroxyl group is obtained. Next, polyisocyanate (PIC) is reacted with the obtained polyester at a temperature of 40 to 140° C. to obtain isocyanate group-containing polyester prepolymer (A). The amines (B) are further reacted with this (A) at the temperature of 0 to 140° C. to obtain urea-modified polyester.

When (PIC) is reacted and (A) is reacted with (B), a solvent can also be used if necessary. Examples of available solvent include those inactive to isocyanate (PIC), such as an aromatic solvent (e.g., toluene, and xylene); ketones (e.g., acetone, methyl ethyl ketone, and methyl isobutyl ketone); esters (e.g., ethyl acetate); amides (e.g., dimethylformamide, and dimethylacetoamide); and ethers (e.g., tetrahydrofuran).

A reaction terminator is used as required for crosslinking reaction between a polyester prepolymer (A) and amines (B) and/or elongation reaction, and the molecular weight of obtained urea-modified polyester can thereby be adjusted. Examples of the reaction terminator include monoamine (e.g., diethylamine, dibutylamine, butylamine, and laurylamine), and compounds (ketimine compounds) in which the monoamines are blocked.

The weight-average molecular weight of the urea-modified polyester is usually 10,000 or more, preferably 20,000 to 10,000,000, and more preferably 30,000 to 1,000,000. If the weight-average molecular weight is less than 10,000, the hot offset resistance deteriorates. A number-average molecular weight of the urea-modified polyester or the like is not particularly limited when the unmodified polyester is used, and the number-average molecular weight should be one with which the weight-average molecular weight can be easily obtained. When the urea-modified polyester is used alone, the number-average molecular weight is usually 2,000 to 15,000, preferably 2,000 to 10,000, and more preferably 2,000 to 8,000. When the number-average molecular weight exceeds 20,000, the low-temperature fixing property deteriorates and the glossiness also deteriorates when used for a full-color image forming apparatus.

By using unmodified polyester in combination with the urea-modified polyester, the low-temperature fixing property is improved and the glossiness is also improved when used for a full-color image forming apparatus, which is more preferable than a single use of the urea-modified polyester. The unmodified polyester may include polyester modified through a chemical bond other than an urea bond.

It is preferable that at least parts of the unmodified polyester and the urea-modified polyester are compatible with each other, in terms of low-temperature fixing property and hot offset resistance. Therefore, the unmodified polyester and the urea-modified polyester have preferably similar compositions.

A weight ratio between the unmodified polyester and the urea-modified polyester is usually 20/80 to 95/5, preferably 70/30 to 95/5, more preferably 75/25 to 95/5, and particularly preferably 80/20 to 93/7. When the weight ratio of urea-modified polyester is less than 5%, the hot offset resistance deteriorates, and this becomes disadvantageous in respect of compatibility between heat resistant preservability and low-temperature fixing property.

A glass transition point (Tg) of binder resin including the unmodified polyester and the urea-modified polyester is usually 45 to 65° C., and preferably 45 to 60° C. If Tg is less than 45° C., the heat resistance of toner deteriorates, while if Tg exceeds 65° C., the low temperature fixing property becomes insufficient.

The urea-modified polyester is likely to be on the surfaces of obtained toner base particles, and, therefore, the toner tends to show better heat resistant preservability as compared with known polyester base toner, even if the glass transition point is low.

(Colorant)

All known dyes and pigments can be used as a colorant, and the followings and mixtures thereof can be used: for example, carbon black, nigrosine dye, iron black, naphthol yellow S, Hansa yellow (10G, 5G, G), cadmium yellow, yellow iron oxide, yellow ocher, chrome yellow, titanium yellow, polyazo yellow, oil yellow, Hansa yellow (GR1, RN, R), pigment yellow L, benzidine yellow (G, GR), permanent yellow (NCG), vulcan fast yellow (5G, R), tartrazine lake, quinoline yellow lake, anthrazane yellow BGL, isoindolinone yellow, red iron oxide, minium, red lead, cadmium red, cadmium mercury red, antimony vermilion, permanent red 4R, para red, fire red, parachloro-ortho-nitroaniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmine 6B, pigment scarlet 3B, bordeaux 5B, toluidine maroon, permanent bordeaux F2K, helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chrome oxide, pyridian, emerald green, pigment green B, naphthol green B, green gold, acid green lake, malachite green lake, phthalocyanine green, anthraquinone green, titanium oxide, zinc white, and lithopone. The content of the colorant is usually 1 to 15 wt %, and preferably 3 to 10 wt % in toner particles.

The colorant can also be used as a master batch combined with resin. Examples of binder resin used to manufacture the master batch or to be kneaded with the master batch include styrene such as polystyrene, poly-p-chlorostyrene, and polyvinyltoluene; polymer as a substitute of the styrene, or copolymers of these and vinyl compounds; polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylate resin, rosin, modified rosin, terpene resin, aliphatic or alicyclic hydrocarbon resin, aromatic petroleum resin, chlorinated paraffin, and paraffin wax. These materials can be used alone or as a mixture thereof.

(Charge Control Agent)

Known charge control agents can be used as a charge control agent, and include, for example, nigrosine-based dye, triphenylmethane-based dye, chromium-containing metal complex dye, chelate molybdate pigment, rhodamine-based dye, alkoxy-based amine, quaternary ammonium salt (including fluorine modified quaternary ammonium salt), alkylamide, phosphorus alone or compounds thereof, tungsten alone or compounds thereof, fluorine-based active agent, salicylic acid metal salt, and metal salt of salicylic acid derivative. More specific examples of the charge control agent are Bontron 03 of nigrosine-based dye, Bontron P-51 of quaternary ammonium salt, Bontron S-34 of metal-containing azo dye, E-82 of oxynaphthoic acid-based metal complex, E-84 of salicylic acid-based metal complex, E-89 of phenol-based condensate (these are manufactured by Orient Chemical Industries, Ltd.), TP-302 and TP-415 of quaternary ammonium salt molybdenum complexes (these are manufactured by Hodogaya Chemical Industries, Ltd.), Copy Charge PSY VP2038 of quaternary ammonium salt, Copy Blue PR of triphenyl methane derivative, Copy Charge NEG VP2036 and Copy Charge NX VP434 of quaternary ammonium salt (these are manufactured by Hoechst Co., Ltd.), LR1-901, and LR-147 as boron complex (manufactured by Japan Carlit Co., Ltd.), copper phthalocyanine, perylene, quinacridone, azo-based pigment, and polymer-based compounds having a functional group such as a sulfonic acid group, a carboxyl group, and a quaternary ammonium salt. Among these, particularly, a substance that controls the toner to have a negative polarity is preferably used.

The use amount of the charge control agent is determined depending on the type of binder resins, presence or absence of additives to be used as required, and a toner manufacturing method including a dispersion method, and, therefore, it is not unambiguously limited. However, the charge control agent is used preferably in a range from 0.1 to 10 parts by weight, and more preferably in a range from 0.2 to 5 parts by weight, per 100 parts by weight of the binder resin. If the amount of use exceeds 10 parts by weight, the toner is charged too highly, which causes effects of the charge control agent to be decreased, electrostatic attracting force between a developing roller and the toner to increase, fluidity of the developer to lower, and image density to decrease.

(Release Agent)

A wax having a low melting point in a range from 50 to 120° C. effectively functions as a release agent between a fixing roller and a toner boundary in dispersion with binder resin. This makes the high temperature offset effective without applying a release agent as oil to the fixing roller. Such wax components include those as follows. Examples of waxes include plant-based wax such as carnauba wax, cotton wax, wood wax, and rice wax; animal-based wax such as beeswax and lanolin; mineral-based wax such as ozokerite and cercine; and petroleum wax such as paraffin, microcrystalline, and petrolatum. Examples of waxes apart from these natural waxes include synthetic hydrocarbon wax such as Fischer-Tropsch wax and polyethylene wax; and synthetic wax such as ester, ketone, and ether. In addition to these, there can be also used fatty acid amide such as 12-hydroxy stearic acid amide, stearic acid amide, phthalic anhydride imide, and chlorinated hydrocarbon; and a crystalline polymer having a long alkyl group in its side chain, such as polyacrylate homopolymer such as poly-n-stearyl methacrylate and poly-n-lauryl methacrylate, or copolymer (e.g., n-stearyl acrylate-ethyl methacrylate copolymer), which are crystalline polymer resin having low molecular weight.

The charge control agent and the release agent can be fused and mixed with the master batch and the binder resin, and may be added to organic solvent at a time of dissolution and dispersion.

(External Additive)

Inorganic fine particles are preferably used as an external additive to facilitate fluidity, developing property, and charging property of toner particles. A primary particle size of the inorganic fine particle is preferably $5\times10^{-3}$ to $^{2}$ μm, and particularly preferably $5\times10^{-3}$ to $^{0.5}$ μm. A specific surface area measured by BET method is preferably 20 to 500 $m^2/g$. A use ratio of the inorganic fine particles is preferably 0.01 to 5 wt % in toner particles, and more preferably 0.01 to 2.0 wt %. Specific examples of the inorganic fine particles include silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, red iron oxide, antimony trioxide, magnesium oxide, zirconium oxide, barium sulfate, barium carbonate, calcium carbonate, silicon carbide, and silicon nitride. Among these materials, hydrophobic silica particles and hydrophobic titanium oxide particles are preferably used in combination as a fluidizing agent. In particular, when the both particles having an average diameter of $5\times10^{-4}$ μm or less are mixed, electrostatic force and van der Waals force with toner particles are significantly improved. As a result, even if such external additives are mixed with toner particles in a developing device to achieve a desired charge level, "firefly" (spot)-free desirable image quality can be obtained without desorption of the fluidizing agent from toner particles, and an amount of residual toner after transfer can be further reduced. While titanium oxide fine particles are excellent in environmental stability and image density stability, the titanium oxide fine particles tend to exhibit degradation in charge rising property. As a result, if an addition amount of titanium oxide fine particles is more than that of silica fine particles, this adverse effect becomes more influential. However, if the addition amount of hydrophobic silica particles and hydrophobic titanium oxide particles is within 0.3 to 1.5 wt %, desired charge rising property is obtained without significant damage to the charge rising property. In other words, even if an image is repeatedly copied, stable image quality can be obtained.

Next, a toner manufacturing method is explained below. Here, exemplary examples of the toner manufacturing method are explained below, however, the method is not limited to these examples.

(Toner Manufacturing Method)

(1) Toner material solution is produced by dispersing a colorant, an unmodified polyester, an isocyanate group-containing polyester prepolymer, and a release agent in organic solvent.

It is preferable that the organic solvent be volatile and have a boiling point of less than 100° C. from the viewpoint of easy removal of formed toner base particles. More specifically, the followings can be used alone or in combination with two or more types thereof, such as toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. In particular, aromatic-based solvent such as toluene and xylene, methylene chloride, 1,2-dichloroethane, chloroform, and halogenated hydrocarbon such as carbon tetrachloride are preferred. The use amount of organic solvent is usually 0 to 300 parts by weight for 100 parts by weight of polyester prepolymer, preferably 0 to 100 parts by weight, and further preferably 25 to 70 parts by weight.

(2) The toner material solution is emulsified in aqueous medium in the presence of a surfactant and resin fine particles.

The aqueous medium may be water alone or contain organic solvent such as alcohol (e.g., methanol, isopropyl alcohol, and ethylene glycol), dimethyl formamide, tetrahydrofuran, cellosolves (e.g., methyl cellosolve), and lower ketones (e.g., acetone, methyl ethyl ketone).

The use amount of the aqueous medium for 100 parts by weight of the toner material solution is usually 50 to 2,000 parts by weight, and preferably 100 to 1,000 parts by weight. If the amount is less than 50 parts by weight, the toner material solution is poorly dispersed, and it is thereby impossible to obtain toner particles having a predetermined particle size. If the amount exceeds 20,000 parts by weight, this is not economical.

Furthermore, in order to improve the dispersion in the aqueous medium, a dispersing agent such as a surfactant and resin fine particles are added as required.

Examples of the surfactant are anionic surfactants such as alkyl benzene sulfonate, α-olefin sulfonate, and ester phosphate; cationic surfactants such as amine salt type such as alkyl amine salt, aminoalcohol fatty acid derivative, polyamine fatty acid derivative, and imidazoline, and a quaternary ammonium salt type such as alkyl trimethyl ammonium salt, dialkyl dimethyl ammonium salt, alkyl dimethyl benzyl ammonium salt, pyridinium salt, alkyl isoquinolinium salt, and benzethonium chloride; nonionic surfactants such as fatty acid amide derivative and polyhydric alcohol derivative; and ampholytic surfactants such as alanine, dodecyl di(aminoethyl)glycine, di(octylaminoethyl)glycine, N-alkyl-N, and N-dimethyl ammonium betaine.

Furthermore, a surfactant having a fluoroalkyl group is used to achieve a desired effect with a very small amount thereof. Preferable examples of anionic surfactants having a fluoroalkyl group are fluoroalkyl carboxylic acid having 2 to 10 carbon atoms and a metal salt thereof; disodium perfluorooctane sulfonyl glutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propane sulfonate, fluoroalkyl (C11 to C20) carboxylic acid and a metal salt thereof; perfluoroalkyl carboxylic acid (C7 to C13) and a metal salt thereof; perfluoroalkyl (C4 to C12) sulfonic acid and a metal salt thereof; perfluorooctane sulfonic acid diethanolamide, N-propyl-N-(2-hydroxyethyl)perfluorooctane sulfonamide, perfluoroalkyl (C6 to C10) sulfonamide propyl trimethyl ammonium salt, perfluoroalkyl (C6 to C10)-N-ethylsulfonyl glycine salt, and monoperfluoroalkyl (C6 to C16) ethyl phosphoric acid ester.

Examples of trade names of these surfactants are Surflon S-111, S-112, and S-113 (manufactured by Asahi Glass Co., Ltd.), Fluorad FC-93, FC-95, FC-98, and FC-129 (manufactured by Sumitomo 3M Co., Ltd.), Unidyne DS-101 and DS-102 (manufactured by Daikin Industries, Ltd.), Megaface F-110, F-120, F-113, F-191, F-812, and F-833 (manufactured by Dainippon Ink & Chemicals, Inc.), Ektop EF-102, 103, 104, 105, 112, 123A, 123B, 306A, 501, 201, and 204 (manufactured by Tochem Products Co., Ltd.), and Ftergent F-100 and F150 (manufactured by Neos Co., Ltd.).

Examples of cationic surfactants are aliphatic primary, secondary, or tertiary amine acid containing a fluoroalkyl group, aliphatic quaternary ammonium salt such as ammonium salt of perfluoroalkyl (C6-C10) sulfonamide propyl trimethyl; benzalkonium salt, benzethonium chloride, pyridinium salt, and imidazolinium salt. Trade names thereof are Surflon S-121 (manufactured by Asahi Glass Co., Ltd.), Fluorad FC-135 (manufactured by Sumitomo 3M Co., Ltd.), Unidyne DS-202 (manufactured by Daikin Industries, Ltd.), Megaface F-150 and F-824 (manufactured by Dainippon Ink & Chemicals, Inc.), Ektop EF-132 (manufactured by Tochem Products Co., Ltd.), and Ftergent F-300 (manufactured by Neos Co., Ltd.), or the like.

The resin fine particles are added to stabilize toner base particles that are formed in the aqueous medium. Therefore, it is preferable that the resin fine particles be added so that a surface coverage of the toner base particles by the resin fine particles is from 10% to 90%. Examples of the resin fine particles are fine particles of polymethyl methacrylate having a particle size of 1 μm and 3 μm; fine particles of polystyrene: 0.5 μm and 2 μm; and fine particles of poly (styrene-acrylonitrile): 1 μm. Examples of trade names of the resin fine particles are PB-200H (manufactured by Kao Corp.), SGP (manufactured by Soken Co., Ltd.), Technopolymer-SB (manufactured by Sekisui Plastics Co., Ltd.), SGP-3G (manufactured by Soken Co., Ltd.), and Micropearl (manufactured by Sekisui Fine Chemical Co. Ltd.). Furthermore, an inorganic compound dispersing agent, such as tricalcium phosphate, calcium carbonate, titanium oxide, colloidal silica, and hydroxyapatite, can be used.

As a dispersing agent that can be used in combination with the resin particles and the inorganic compound dispersing agent, dispersion droplets may be stabilized by a high polymer-based protective colloid. Examples of the polymer protective colloid include acids such as acrylic acid, methacrylic acid, α-cyanoacrylic acid, α-cyanomethacrylic acid, itaconic acid, crotonic acid, fumaric acid, maleic acid, or maleic anhydride; or a (meth)acrylic-based monomer containing a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro 2-hydroxypropyl acrylate, 3-chloro 2-hydroxypropyl methacrylate, diethylene glycol monoacrylic ester, diethylene glycol monomethacrylic ester, glycerin monoacrylic ester, glycerin monomethacrylic ester, N-methylol acrylamide, and N-methylol methacrylamide; vinyl alcohol or ethers with vinyl alcohol such as vinyl methyl ether, vinyl ethyl ether, vinyl propyl ether; or esters of a compound that contains a vinyl alcohol and a carboxyl group such as vinyl acetate, vinyl propionate, and vinyl butyrate; acrylamide, methacrylamide, diacetone acrylamide or their methylol compounds; acid chlorides such as chloride acrylate and chloride methacrylate; homopolymer or copolymer of nitrogen-containing compounds such as vinylpyridine, vinylpyrrolidone, vinylimidazole, and ethyleneimine, or of heterocyclic ring thereof; polyoxyethylene compounds such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester; and celluloses such as methyl cellulose, hydroxyethyl cellulose, and hydroxypropyl cellulose.

A dispersion method is not particularly limited, and a known equipment of a low-speed shearing type, a high-speed shearing type, a friction type, a high-pressure jet type, or an ultrasonic type can be used. Among these, the high-speed shearing type is preferred to obtain dispersed particles having a particle size of 2 to 20 μm. When a high-speed shearing type dispersing machine is used, the number of revolutions is not particularly limited, but is usually 1,000 to 30,000 rpm, and preferably 5,000 to 20,000 rpm. The dispersion time is not particularly limited, and is usually 0.1 to 5 minutes in a batch system. The temperature at the time of dispersion is usually 0 to 150° C. (under pressure), preferably 40 to 98° C.

(3) During preparation of an emulsion, amines (B) are added and reacted with polyester prepolymer (A) having an isocyanate group.

This reaction is followed by crosslinking and/or elongation of a molecular chain. The reaction time is selected according to the reactivity between an isocyanate group structure of the polyester prepolymer (A) and the amines (B), and is usually 10 minutes to 40 hours, preferably 2 to 24 hours. The reaction temperature is usually 0 to 150° C., preferably 40 to 98° C. Moreover, a known catalyst can be used if necessary. Specific examples of the catalyst are dibutyltin laurate and dioctyltin laurate.

(4) After completion of the reaction, the organic solvent is removed from emulsified dispersion (reaction product), and the reaction product is washed and dried, to obtain the toner base particles.

To remove the organic solvent, the whole system is gradually heated up while a laminar flow is stirred, and is stirred vigorously in a certain temperature range, followed by removal of the solvent, thus producing spindle-shaped toner base particles. When a substance such as calcium phosphate salt soluble in an acid or an alkali is used as a dispersion stabilizer, the calcium phosphate salt is removed from the toner base particles by a method of dissolving the calcium phosphate salt with an acid like hydrochloric acid and washing the calcium phosphate salt with water. The calcium phosphate salt can also be removed through decomposition by some other enzymes.

(5) A charge control agent is implanted into the obtained toner base particles, and inorganic fine particles such as silica fine particles and titanium oxide fine particles are added externally to obtain the toner. The implantation of the charge control agent and the external addition of the inorganic fine particles are performed by a known method using a mixer or the like.

Accordingly, the toner having a small particle size and a sharp particle-size distribution can be obtained easily. Moreover, by vigorously stirring the toner in the process of removing the organic solvent, the shape of particles can be controlled in a range from a perfectly spherical shape to a spindle shape. Furthermore, the morphology of the surface can also be controlled in a range from a smooth shape to a rough shape.

Figure 9A:
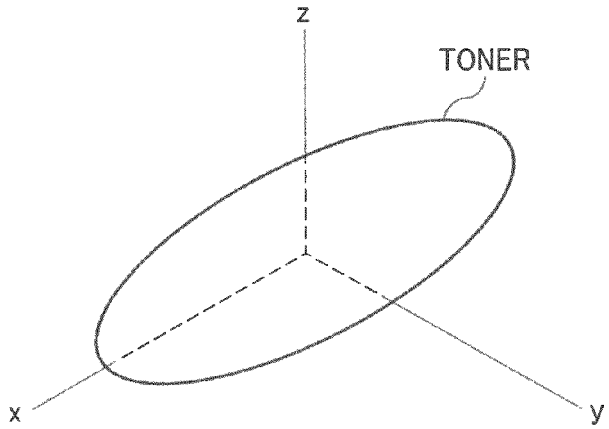
FIGS. 9A, 9B, and 9C are diagrams schematically representing shapes of toner particles.
Figure 9B:
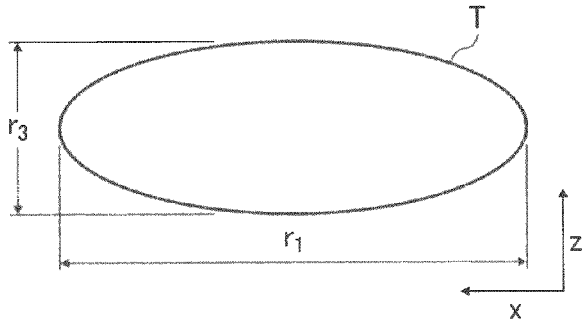
Figure 9C:
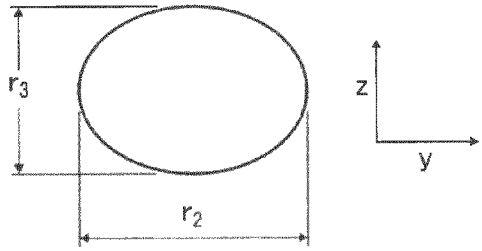

The shape of the toner is substantially spherical, and can be expressed by the following shape definition. FIGS. 9A, 9B, and 9C are schematic diagrams of the shape of the toner. As shown in FIGS. 9A, 9B, and 9C, it is assumed that a substantially spherical toner is defined by a major axis $r_1$, a minor axis $r_2$, and a thickness $r_3$ (where $r_1 \geq r_2 \geq r_3$). The toner particle is preferably in the following ranges: a ratio ($r_2/r_1$) between the major axis and the minor axis (see FIG. 9B) is in a range from 0.5 to 1.0, and a ratio ($r_3/r_2$) between the thickness and the minor axis (see FIG. 9C) is in a range from 0.7 to 1.0. If the ratio ($r_2/r_1$) between the major axis and the minor axis is less than 0.5, the toner shape departs from the perfect sphericity, and dot reproducibility and transfer efficiency thereby degrade. As a result, a high quality image cannot be obtained. If the ratio ($r_3/r_2$) between the thickness and the minor axis is less than 0.7, the toner shape is close to a flat shape, and, therefore, a high transfer rate as that of the spherical toner cannot be obtained. Particularly, if the ratio ($r_3/r_2$) between the thickness and the minor axis is 1.0, the toner becomes a "rotating body" with its major axis as a rotational axis, thereby improving the fluidity of toner.

The $r_1$, $r_2$, and $r_3$ were measured by observing and photographing a toner particle with a scanning electron microscope (SEM) while changing an angle of a visual field.

Figure 10:
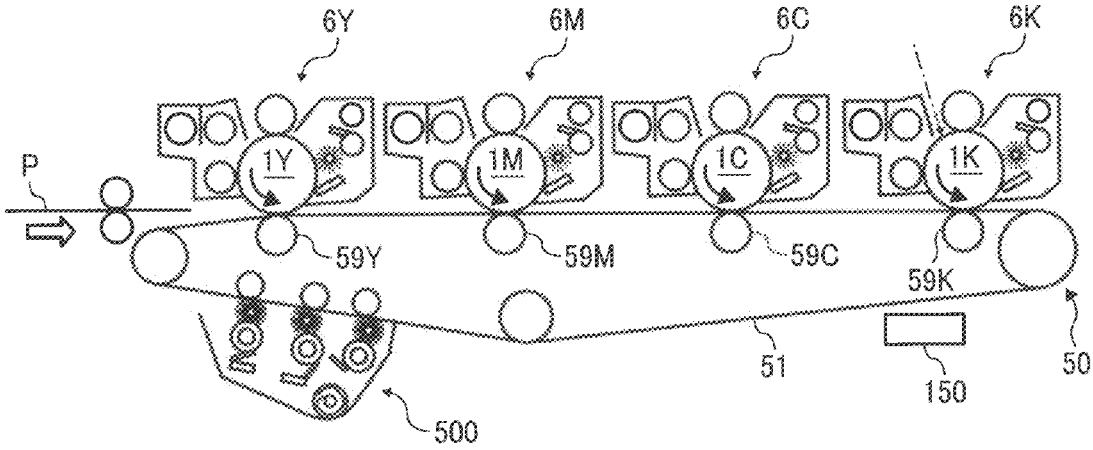
FIG. 10 is a schematic configuration diagram representing a main portion of a printer of a tandem-type direct transfer system.

The cleaning device according to the present invention is not limited to the belt cleaning device 100 for cleaning the top side of the intermediate transfer belt, and, as shown in FIG. 10, the cleaning device can be applied to a conveyor-belt cleaning device 500 for a paper conveyor belt 51. As shown in FIG. 10, the paper conveyor belt 51 which is a body to be cleaned used for an image forming apparatus of a tandem-type direct transfer system is in contact with the photosensitive elements 1Y, 1M, 1C, and 1K to form primary transfer nips for Y, M, C, and K, respectively. The paper conveyor belt 51 sequentially feeds the recording paper P into the primary transfer nips for Y, M, C, and K during the process of conveying the recording paper from the left side to the right side of the figure in association with its endless movement while holding the recording paper P on its surface. In this way, the Y, M, C, and K toner images are primarily transferred to the recording paper P in a superimposed manner. Dirt such as toner adhering to the paper conveyor belt 51 after having passed through the primary transfer nip for K is removed by the conveyor-belt cleaning device 500. The optical sensor unit 150 is disposed so as to face the top side of the paper conveyor belt 51 via a predetermined space. The printer shown in FIG. 10 also implements image density control and positional-displacement correction control at a predetermined timing, forms predetermined toner patterns (gray-scale patterns, chevron patches) on the paper conveyor belt 51, detects the toner patterns by the optical sensor unit 150, and executes a predetermined correction process based on the result of detection. The toner patterns being un-transferred toner images after they are detected by the optical sensor unit 150 are removed by the conveyor-belt cleaning device 500. As explained above, the paper conveyor belt 51 has a function as an image carrier for carrying the toner image thereon.

By applying the cleaning device according to the present invention to the conveyor-belt cleaning device 500, the toner pattern formed on the paper conveyor belt 51 can be satisfactorily removed, and the back of the recording paper can be prevented from being contaminated by toner or the like.

Figure 11:
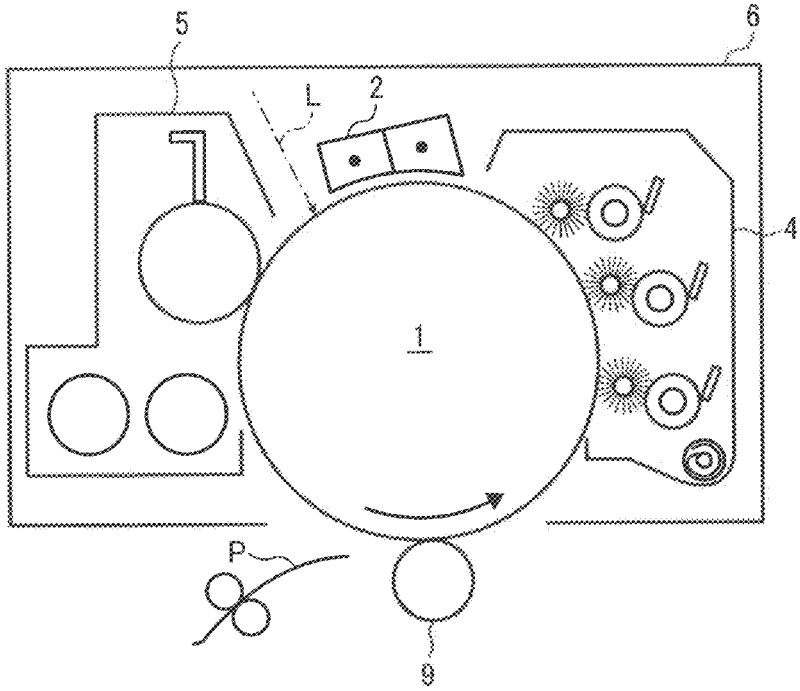
FIG. 11 is a schematic configuration diagram representing a main portion of a monochrome printer.

As shown in FIG. 11, the cleaning device according to the present invention can also be applied to a drum cleaning device 4. Un-transferred toner images such as a toner consumption pattern at a time of executing a refresh mode for refreshing the inside of the developing device and a toner image on the photosensitive element at a time of occurrence of a paper jam are input to the drum cleaning device 4. By applying the cleaning device according to the present invention to the drum cleaning device 4, the un-transferred toner images input to the drum cleaning device 4 can be satisfactorily removed.

Next, confirmatory experiments of the cleaning device according to the present invention will be explained.

(Confirmatory Experiments)

In the cleaning device shown in FIG. 4, each biting depth of each of brush rollers to the intermediate transfer belt at the pre-cleaning unit, the polarity control unit, and the normally-charged-toner cleaning unit; a peripheral speed of the brush roller; a biting depth of the brush roller to the collecting roller; and a peripheral speed of the collecting roller were made different from each other in Example and Comparative Example, to conduct paper passing experiments. Paper passing conditions are such that an image-area ratio was 5%, and 400,000 sheets of paper for A4 print were passed. At this time, the refresh mode of the developer is used between sheets, and toner having a concentration of M/A=1.0 mg/cm$^2$ is input to the cleaning unit.

EXAMPLE

Biting depth of each of the following brush rollers to the intermediate transfer belt
- Pre-cleaning brush roller 101: 1.5 mm
- Polarity-control brush roller 104: 0.7 mm
- Normally-charged-toner cleaning brush roller 107: 1.0 mm Relative speed of each of the following brush rollers to the intermediate transfer belt at its contact portion with the intermediate transfer belt
- Pre-cleaning brush roller 101: 1000 mm/s
- Polarity-control brush roller 104: 750 mm/s
- Normally-charged-toner cleaning brush roller 107: 850 mm/s Biting depth of each of the following collecting rollers to the corresponding brush roller
- Pre-collecting roller 102: 1.5 mm
- Oppositely-charged-toner collecting roller 105: 0.7 mm
- Normally-charged-toner collecting roller 108: 1.0 mm Relative speed of each of the following collecting rollers to the corresponding brush roller at its contact portion with the brush roller
- Pre-collecting roller 102: 1000 mm/s
- Oppositely-charged-toner collecting roller 105: 375 mm/s
- Normally-charged-toner collecting roller 108: 550 mm/s

COMPARATIVE EXAMPLE

Biting depth of each of the following brush rollers to the intermediate transfer belt
- Pre-cleaning brush roller 101: 1.5 mm
- Polarity-control brush roller 104: 1.5 mm
- Normally-charged-toner cleaning brush roller 107: 1.5 mm Relative speed of each of the following brush rollers to the intermediate transfer belt at its contact portion with the intermediate transfer belt
- Pre-cleaning brush roller 101: 1000 mm/s
- Polarity-control brush roller 104: 1000 mm/s
- Normally-charged-toner cleaning brush roller 107: 1000 mm/s Biting depth of each of the following collecting rollers to the corresponding brush roller
- Pre-collecting roller 102: 1.5 mm
- Oppositely-charged-toner collecting roller 105: 1.5 mm
- Normally-charged-toner collecting roller 108: 1.5 mm Relative speed of each of the following collecting rollers to the corresponding brush roller at its contact portion with the brush roller
- Pre-collecting roller 102: 1000 mm/s
- Oppositely-charged-toner collecting roller 105: 1000 mm/s
- Normally-charged-toner collecting roller 108: 1000 mm/s As a result of the confirmatory experiments conducted in the conditions, it is confirmed that a cleaning failure did not occur until the end of the experiments in the conditions of Example, while a cleaning failure occurred at the middle of the experiments in the conditions of Comparative Example.

As mentioned above, the belt cleaning device 100 being the cleaning device according to the embodiment includes the normally-charged-toner cleaning brush roller 107 being a normally-charged-toner cleaning member for being applied with a voltage having the polarity opposite to the normal charge polarity of the toner and electrostatically removing the toner having the normal charge polarity on the intermediate transfer belt 8 being the body to be cleaned; and the polarity-control brush roller 104 being an oppositely-charged-toner cleaning member for being applied with a voltage having the same polarity as the normal charge polarity of the toner and electrostatically removing the toner having the polarity opposite to the normal charge polarity on the intermediate transfer belt 8. The belt cleaning device 100 also includes the pre-cleaning brush roller 101 being a pre-cleaning member, provided on the upstream side of the normally-charged-toner cleaning brush roller 107 and the polarity-control brush roller 104 in the surface moving direction of the intermediate transfer belt 8, for being applied with a voltage having a polarity opposite to the normal charge polarity of the toner and electrostatically removing the toner having the normal charge polarity.

By providing this configuration, when the un-transferred toner including a large amount of toner charged to the normal charge polarity is input to the belt cleaning device 100, the toner charged to the normal charge polarity of the un-transferred toner image can be roughly removed by the pre-cleaning brush roller 101. Thus, there is reduced the amount of toner input to the normally-charged-toner cleaning brush roller 107 and the polarity-control brush roller 104 which are provided on the downstream side of the pre-cleaning brush roller 101 in the belt moving direction. This allows the normally-charged-toner cleaning brush roller 107 to satisfactorily remove the toner charged to the normal charge polarity, which cannot be removed by the pre-cleaning brush roller 101. Moreover, the polarity-control brush roller 104 can satisfactorily remove the toner charged to the opposite polarity to the normal charge polarity. Therefore, even if an un-transferred toner image is input to the belt cleaning device, the un-transferred toner image can be satisfactorily removed from the intermediate transfer belt.

The cleaning device includes the polarity control unit for controlling the charge polarity of the toner on the intermediate transfer belt 8 being the body to be cleaned, and the cleaning brush roller being a cleaning member, provided on the downstream of the polarity control unit in the surface moving direction of the intermediate transfer belt 8, for being applied with a voltage having an opposite polarity to the charge polarity of the toner controlled by the polarity control unit and electrostatically removing the toner. However, this cleaning device may be configured to include the pre-cleaning brush roller 101 being the pre-cleaning member, provided on the upstream of the polarity control unit in the surface moving direction of the intermediate transfer belt 8, for being applied with a voltage having an opposite polarity to the normal charge polarity of the toner and electrostatically removing the toner having the normal charge polarity.

In this configuration also, when the un-transferred toner image including a large amount of toner charged to the normal charge polarity is input to the belt cleaning device 100, the pre-cleaning brush roller 101 can roughly remove the toner charged to the normal charge polarity of the un-transferred toner image. In this manner, there is reduced the amount of toner input to the polarity control unit which is provided on the downstream side of the pre-cleaning brush roller 101 in the belt moving direction. As a result, the polarity control unit can excellently control the charge polarity of the toner on the intermediate transfer belt 8. Therefore, the charge polarities of the toner particles input to the cleaning brush roller provided on the downstream side of the polarity control unit in the belt moving direction can be changed to one of the polarities. Besides, the amount of toner input to the cleaning brush roller is small, and this enables the cleaning brush roller to satisfactorily remove the toner on the intermediate transfer belt 8, which cannot be removed by the pre-cleaning brush roller. As a result, even if an un-transferred toner image is input to the belt cleaning device, the un-transferred toner image can be satisfactorily removed from the intermediate transfer belt.

In the cleaning device according to the present embodiment, each relative speed of the polarity-control brush roller 104 and the normally-charged-toner cleaning brush roller 107 being cleaning members, to the intermediate transfer belt, provided on the downstream side of the pre-cleaning brush roller in the surface moving direction of the intermediate transfer belt 8 is set to be slower than the relative speed of the pre-cleaning brush roller 101 to the intermediate transfer belt. This can suppress the wearing of the polarity-control brush roller 104 and the normally-charged-toner cleaning brush roller 107 as compared with the case where each relative speed of the polarity-control brush roller 104 and the normally-charged-toner cleaning brush roller 107 to the intermediate transfer belt 8 is set to the same as the relative speed of the pre-cleaning brush roller 101 to the intermediate transfer belt 8. This allows each life of the polarity-control brush roller 104 and the normally-charged-toner cleaning brush roller 107 to be prolonged. Meanwhile, because each relative speed of the polarity-control brush roller 104 and the normally-charged-toner cleaning brush roller 107 to the intermediate transfer belt 8 is set to be slower than the relative speed of the pre-cleaning brush roller 101 to the intermediate transfer belt 8, the cleaning property decreases more than that of the pre-cleaning brush roller 101. However, each amount of toner input to the polarity-control brush roller 104 and the normally-charged-toner cleaning brush roller 107 is less than that to the pre-cleaning brush roller 101. Therefore, even if the cleaning property decreases more than that of the pre-cleaning brush roller 101, the polarity-control brush roller 104 can satisfactorily remove the oppositely charged toner, and the normally-charged-toner cleaning brush roller 107 can excellently remove the normally charged toner.

Each biting depth of the polarity-control brush roller 104 and the normally-charged-toner cleaning brush roller 107, to the intermediate transfer belt, which are cleaning members provided on the downstream side of the pre-cleaning brush roller 101 in the surface moving direction of the intermediate transfer belt 8, may be made less than the biting depth of the pre-cleaning brush roller 101 to the intermediate transfer belt. This can suppress the wearing of the polarity-control brush roller 104 as compared with the case where the biting depth of the polarity-control brush roller 104 to the intermediate transfer belt 8 is set to the same as the biting depth of the normally-charged-toner cleaning brush roller 107 to the intermediate transfer belt 8. This allows the life of the polarity-control brush roller 104 to be prolonged. Meanwhile, by making the biting depth of the polarity-control brush roller 104 to the intermediate transfer belt 8 less than the biting depth of the normally-charged-toner cleaning brush roller 107 to the intermediate transfer belt 8, the cleaning property of the polarity-control brush roller 104 decreases more than that of the normally-charged-toner cleaning brush roller 107. However, the amount of oppositely charged toner removed by the polarity-control brush roller 104 is less than the normally charged toner removed by the normally-charged-toner cleaning brush roller 107. Therefore, even if the cleaning property of the polarity-control brush roller 104 decreases more than that of the normally-charged-toner cleaning brush roller 107, the polarity-control brush roller 104 can satisfactorily remove the oppositely charged toner.

In addition, each relative speed of the oppositely-charged-toner collecting roller 105 and the normally-charged-toner collecting roller 108, to the cleaning brushes, each of which is a collecting member for collecting the toner of the cleaning brush rollers provided on the downstream side of the pre-cleaning brush roller 101 in the moving direction of the intermediate transfer belt 8, may be made slower than the relative speed of the pre-collecting roller 102 being a pre-collecting member to the pre-cleaning brush roller 101. By configuring the components in the above manner, the wearing of the polarity-control brush roller 104 and the normally-charged-toner cleaning brush roller 107 is suppressed and each life of the polarity-control brush roller 104 and the normally-charged-toner cleaning brush roller 107 can be prolonged, as compared with the case where the each relative speed of the oppositely-charged-toner collecting roller 105 and the normally-charged-toner collecting roller 108 to the cleaning brushes may be made the same as the relative speed of the pre-collecting roller 102 to the pre-cleaning brush roller 101. The wearing of the oppositely-charged-toner collecting roller 105 and the normally-charged-toner collecting roller 108 can also be suppressed, and each life of the oppositely-charged-toner collecting roller 105 and the normally-charged-toner collecting roller 108 can be prolonged. In addition, because each amount of toner adhering to the polarity-control brush roller 104 and the normally-charged-toner cleaning brush roller 107 is small, even if each relative speed of the oppositely-charged-toner collecting roller 105 and the normally-charged-toner collecting roller 108 to the corresponding brush rollers is set to be slower than the relative speed of the pre-collecting roller 102 to the brush roller, the toner can be effectively collected from the brushes. Therefore, there is almost no toner remaining on the polarity-control brush roller 104 and the normally-charged-toner cleaning brush roller 107 without being collected from the brushes by the collecting rollers. Accordingly, the cleaning property of the polarity-control brush roller 104 will not decrease, and this allows satisfactory removal of the oppositely charged toner from the intermediate transfer belt 8.

Each biting depth of the oppositely-charged-toner collecting roller 105 and the normally-charged-toner collecting roller 108 to the corresponding cleaning brushes may be made less than the biting depth of the pre-collecting roller 102 to the pre-cleaning brush roller 101. By configuring the components in the above manner, the wearing of the polarity-control brush roller 104 and the normally-charged-toner cleaning brush roller 107 can be suppressed as compared with the case where the each biting depth of the oppositely-charged-toner collecting roller 105 and the normally-charged-toner collecting roller 108 to the cleaning brushes may be made the same as the relative speed of the pre-collecting roller 102 to the pre-cleaning brush roller 101. This enables each life of the polarity-control brush roller 104 and the normally-charged-toner cleaning brush roller 107 to be prolonged. The wearing of the oppositely-charged-toner collecting roller 105 and the normally-charged-toner collecting roller 108 can also be suppressed, and each life of the oppositely-charged-toner collecting roller 105 and the normally-charged-toner collecting roller 108 can be prolonged. In addition, because each amount of toner adhering to the polarity-control brush roller 104 and the normally-charged-toner cleaning brush roller 107 is small, even if each biting depth of the oppositely-charged-toner collecting roller 105 and the normally-charged-toner collecting roller 108 to the corresponding brush rollers is made less than the biting depth of the pre-collecting roller 102 to the brush roller, the toner can be effectively collected from the brushes. Therefore, there is almost no toner remaining on the polarity-control brush roller 104 and the normally-charged-toner cleaning brush roller 107 without being collected from the brushes by the collecting rollers. Accordingly, the cleaning property of the polarity-control brush roller 104 does not decrease, and this allows successful removal of the oppositely charged toner from the intermediate transfer belt 8.

The polarity-control brush roller 104 provided on the upstream side of the normally-charged-toner cleaning brush roller 107 in the surface moving direction of the intermediate transfer belt 8 electrostatically removes the toner while applying an electric charge having the same polarity as the normal charge polarity to the toner on the intermediate transfer belt 8. In this manner, the polarities of the toner particles on the intermediate transfer belt 8 input to the normally-charged-toner cleaning brush roller 107 can be changed to the normal charge polarity. This enables the toner on the intermediate transfer belt 8 having passed through the polarity-control brush roller 104 to be reliably and electrostatically attracted to the normally-charged-toner cleaning brush roller 107 and be removed.

In this case, the amount of toner removed by the polarity-control brush roller 104 is less than the amount of toner removed by the normally-charged-toner cleaning brush roller 107. Therefore, the relative speed of the polarity-control brush roller 104 to the intermediate transfer belt is set to be slower than the relative speed of the normally-charged-toner cleaning brush roller 107 to the intermediate transfer belt. This allows the life of the polarity-control brush roller 104 to be prolonged as compared with the case where the relative speed of the polarity-control brush roller 104 to the intermediate transfer belt is set to the same as the relative speed of the normally-charged-toner cleaning brush roller 107 to the intermediate transfer belt. Meanwhile, by setting the relative speed of the polarity-control brush roller 104 to the intermediate transfer belt 8 to be slower than the relative speed of the normally-charged-toner cleaning brush roller 107 to the intermediate transfer belt 8, the cleaning property of the polarity-control brush roller 104 decreases more than that of the normally-charged-toner cleaning brush roller 107. However, the amount of the oppositely charged toner removed by the polarity-control brush roller 104 is less than the normally charged toner removed by the normally-charged-toner cleaning brush roller 107. Therefore, even if the cleaning property of the polarity-control brush roller 104 decreases more than the normally-charged-toner cleaning brush roller 107, the polarity-control brush roller 104 can satisfactorily remove the oppositely charged toner.

The biting depth of the polarity-control brush roller 104 to the intermediate transfer belt may be made less than the biting depth of the normally-charged-toner cleaning brush roller 107 to the intermediate transfer belt. In this configuration also, the life of the polarity-control brush roller 104 can be prolonged as compared with the case where the biting depth of the polarity-control brush roller 104 to the intermediate transfer belt is set to the same as the biting depth of the 107 roller to the intermediate transfer belt. Meanwhile, by making the biting depth of the polarity-control brush roller 104 to the intermediate transfer belt 8 less than the biting depth of the normally-charged-toner cleaning brush roller 107 to the intermediate transfer belt 8, the cleaning property of the polarity-control brush roller 104 decreases more than that of the normally-charged-toner cleaning brush roller 107. However, the amount of the oppositely charged toner removed by the polarity-control brush roller 104 is less than the normally charged toner removed by the normally-charged-toner cleaning brush roller 107. Therefore, even if the cleaning property of the polarity-control brush roller 104 decreases more than the normally-charged-toner cleaning brush roller 107, the polarity-control brush roller 104 can satisfactorily remove the oppositely charged toner.

The relative speed of the oppositely-charged-toner collecting roller 105, to the polarity-control brush roller 104, which is the oppositely-charged-toner collecting member for collecting the toner adhering to the polarity-control brush roller 104 may be made slower than the relative speed of the normally-charged-toner collecting roller 108, to the normally-charged-toner cleaning brush roller 107, which is the normally-charged-toner collecting member for collecting the toner adhering to the normally-charged-toner cleaning brush roller 107. By configuring the components in the above manner, the wearing of the polarity-control brush roller 104 and the oppositely-charged-toner collecting roller 105 can be suppressed as compared with the case where the relative speed of the oppositely-charged-toner collecting roller 105 to the brush roller is made the same as the relative speed of the normally-charged-toner collecting roller 108 to the brush roller. This allows each life of the polarity-control brush roller 104 and the oppositely-charged-toner collecting roller 105 to be prolonged. Meanwhile, by setting the relative speed of the oppositely-charged-toner collecting roller 105 to the brush roller to be slower than the relative speed of the normally-charged-toner collecting roller 108 to the brush roller, the toner collecting capability of the oppositely-charged-toner collecting roller 105 decreases more than the toner collecting capability of the normally-charged-toner collecting roller 108. However, the amount of toner adhering to the polarity-control brush roller 104 is less than the amount of toner adhering to the normally-charged-toner cleaning brush roller. Therefore, even if the toner collecting capability of the oppositely-charged-toner collecting roller 105 decreases more than the toner collecting capability of the normally-charged-toner collecting roller 108, the toner on the polarity-control brush roller 104 can be satisfactorily collected by the oppositely-charged-toner collecting roller 105.

The biting depth of the oppositely-charged-toner collecting roller 105 to the polarity-control brush roller 104 may be made less than the biting depth of the normally-charged-toner collecting roller 108 to the normally-charged-toner cleaning brush roller 107. By configuring the components in the above manner, the wearing of the polarity-control brush roller 104 and the oppositely-charged-toner collecting roller 105 can be suppressed as compared with the case where the biting depth of the oppositely-charged-toner collecting roller 105 to the brush roller is made the same as the biting depth of the normally-charged-toner collecting roller 108 to the brush roller. This allows each life of the polarity-control brush roller 104 and the oppositely-charged-toner collecting roller 105 to be prolonged. Meanwhile, by making the biting depth of the oppositely-charged-toner collecting roller 105 to the brush roller less than the biting depth of the normally-charged-toner collecting roller 108 to the brush roller, the toner collecting capability of the oppositely-charged-toner collecting roller 105 decreases more than the toner collecting capability of the normally-charged-toner collecting roller 108. However, the amount of toner adhering to the polarity-control brush roller 104 is less than the amount of toner adhering to the normally-charged-toner cleaning brush roller 107. Therefore, even if the toner collecting capability of the oppositely-charged-toner collecting roller 105 decreases more than the toner collecting capability of the normally-charged-toner collecting roller 108, the toner on the polarity-control brush roller 104 can be satisfactorily collected by the oppositely-charged-toner collecting roller 105.

In the image forming apparatus which forms an image on a recording paper being a recording material by transferring the toner image formed on the image carrier finally from the image carrier to the recording material, by using the cleaning device as a cleaning device for cleaning the residual toner after transfer remaining on the image carrier after the transfer, the toner on the image carrier can be satisfactorily cleaned off. This enables high-quality image formation to be achieved.

By using the cleaning device according to the present invention as the belt cleaning device 100 for cleaning the intermediate transfer belt 8 being the image carrier, the toner on the intermediate transfer belt 8 can be satisfactorily cleaned off. By enabling the satisfactory cleaning of the toner on the intermediate transfer belt 8, high-quality image formation can be achieved.

As shown in FIG. 10, by using the cleaning device according to the present invention as the conveyor-belt cleaning device 500 that cleans the toner remaining on the conveyor belt for conveying the recording paper, the toner on the paper conveyor belt 51 can be satisfactorily cleaned off. As a result, the back of the recording paper can be prevented from being contaminated by the toner.

According to the present invention, the un-transferred toner image and residual toner after transfer can be satisfactorily removed from the body to be cleaned, and each life of the cleaning members on the downstream side of the pre-cleaning member in the moving direction of the body to be cleaned can be prolonged while maintaining the cleaning performance.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cleaning device comprising:

a normally-charged-toner cleaning member configured to be in contact with a body to be cleaned while rotating, to be applied with a voltage having a polarity opposite to a normal charge polarity of toner, and to electrostatically remove the toner having the normal charge polarity on the body;

an oppositely-charged-toner cleaning member configured to be in contact with the body to be cleaned while rotating, to be applied with a voltage having a same polarity as the normal charge polarity of toner, and to electrostatically remove the toner having a polarity opposite to the normal charge polarity on the body to be cleaned;

a pre-cleaning member configured to be provided on an upstream of the normally-charged-toner cleaning member and the oppositely-charged-toner cleaning member in a surface moving direction of the body, to be in contact with the body while rotating, to be applied with a voltage having a polarity opposite to the normal charge polarity of toner, and to electrostatically remove the toner having the normal charge polarity on the body;

an oppositely-charged-toner collecting member configured to be in contact with the oppositely-charged-toner cleaning member, and to collect toner adhering to the oppositely-charged-toner cleaning member;

a normally-charged-toner collecting member configured to be in contact with the normally-charged-toner cleaning member, and to collect toner adhering to the normally-charged-toner cleaning member; and a pre-collecting member configured to be in contact with the pre-cleaning member, and to collect toner adhering to the pre-cleaning member, wherein the cleaning device is configured to include at least one of the following four configurations:

a relative speed of the normally-charged-toner cleaning member to the body at a contact portion between the normally-charged-toner cleaning member and the body and a relative speed of the oppositely-charged-toner cleaning member to the body at a contact portion between the oppositely-charged-toner cleaning member and the body are made slower than a relative speed of the pre-cleaning member to the body at a contact portion between the pre-cleaning member and the body, a biting depth of the normally-charged-toner cleaning member to the body and a biting depth of the oppositely-charged-toner cleaning member to the body are made less than a biting depth of the pre-cleaning member to the body, a relative speed of the oppositely-charged-toner collecting member to the oppositely-charged-toner cleaning member at a contact portion between the oppositely-charged-toner collecting member and the oppositely-charged-toner cleaning member and a relative speed of the normally-charged-toner collecting member to the normally-charged-toner cleaning member at a contact portion between the normally-charged-toner collecting member and the normally-charged-toner cleaning member are made an amount slower than a relative speed of the pre-collecting member to the pre-cleaning member at a contact portion between the pre-collecting member and the pre-cleaning member, and a biting depth of the normally-charged-toner collecting member to the normally-charged-toner cleaning member and a biting depth of the oppositely-charged-toner collecting member to the oppositely-charged-toner cleaning member are made less than a biting depth of the pre-collecting member to the pre-cleaning member.

2. The cleaning device according to claim 1, wherein, when the oppositely-charged-toner cleaning member is provided on an upstream side of the normally-charged-toner cleaning member in the surface moving direction, the oppositely-charged-toner cleaning member removes toner on the body electrostatically while applying an electric charge having a same polarity as a polarity of a voltage applied to the oppositely-charged-toner cleaning member, to the toner on the body, and when the normally-charged-toner cleaning member is provided on an upstream side of the oppositely-charged-toner cleaning member in the surface moving direction, the normally-charged-toner cleaning member removes toner on the body electrostatically while applying an electric charge having a same polarity as a polarity of a voltage applied to the normally-charged-toner cleaning member, to the toner on the body, and when the oppositely-charged-toner cleaning member is provided on the upstream side of the normally-charged-toner cleaning member in the surface moving direction, a relative speed of the oppositely-charged-toner cleaning member to the body at the contact portion between the oppositely-charged-toner cleaning member and the body is set to be slower than a relative speed of the normally-charged-toner cleaning member to the body at the contact portion between the normally-charged-toner cleaning member and the body, and when the normally-charged-toner cleaning member is provided on the upstream side of the oppositely-charged-toner cleaning member in the surface moving direction, a relative speed of the normally-charged-toner cleaning member to the body at the contact portion between the normally-charged-toner cleaning member and the body is set to be slower than a relative speed of the oppositely-charged-toner cleaning member to the body at the contact portion between the oppositely-charged-toner cleaning member and the body.

3. The cleaning device according to claim 1, wherein, when the oppositely-charged-toner cleaning member is provided on an upstream side of the normally-charged-toner cleaning member in the surface moving direction, the oppositely-charged-toner cleaning member removes toner on the body electrostatically while apple an electric charge having a same polarity as a polarity of a voltage applied to the oppositely-charged-toner cleaning member, to the toner on the body, and when the normally-charged-toner cleaning member is provided on an upstream side of the oppositely-charged-toner cleaning member in the surface moving direction, the normally-charged-toner cleaning member removes toner on the body electrostatically while applying an electric charge having a same polarity as a polarity of a voltage applied to the normally-charged-toner cleaning member, to the toner on the body, and when the oppositely-charged-toner cleaning member is provided on the upstream side of the normally-charged-toner cleaning member in the surface moving direction, the biting depth of the oppositely-charged-toner cleaning member to the body at the contact portion between the oppositely-charged-toner cleaning member and the body is made less than the biting depth of the normally-charged-toner cleaning member to the body at the contact portion between the normally-charged-toner cleaning member and the body, and when the normally-charged-toner cleaning member is provided on the upstream side of the oppositely-charged-toner cleaning member in the surface moving direction, the biting depth of the normally-charged-toner cleaning member to the body at the contact portion between the normally-charged-toner cleaning member and the body is made less than the biting depth of the oppositely-charged-toner cleaning member to the body at the contact portion between the oppositely-charged-toner cleaning member and the body.

4. The cleaning device according to claim 1, wherein, when the cleaning device includes one of:

the configuration that the relative speed of the normally-charged-toner cleaning member to the body at the contact portion between the normally-charged-toner cleaning member and the body and the relative speed of the oppositely-charged-toner cleaning member to the body at the contact portion between the oppositely-charged-toner cleaning member and the body are made slower than the relative speed of the pre-cleaning member to the body at the contact portion between the pre-cleaning member and the body, and the configuration that the biting depth of the normally-charged-toner cleaning member to the body and the biting depth of the oppositely-charged-toner cleaning member to the body are made less than the biting depth of the pre-cleaning member to the body, the relative speed of the oppositely-charged-toner collecting member to the oppositely-charged-toner cleaning member at the contact portion between the oppositely-charged-toner collecting member and the oppositely-charged-toner cleaning member and the relative speed of the normally-charged-toner collecting member to the normally-charged-toner cleaning member at the contact portion between the normally-charged-toner collecting member and the normally-charged-toner cleaning member are made an additional amount slower than the relative speed of the pre-collecting member to the pre-cleaning member at the contact portion between the pre-collecting member and the pre-cleaning member.

5. The cleaning device according to claim 1, wherein, when the oppositely-charged-toner cleaning member is provided on an upstream side of the normally-charged-toner cleaning member in the surface moving direction, the oppositely-charged-toner cleaning member removes toner on the body electrostatically while applying an electric charge having a same polarity as a polarity of a voltage applied to the oppositely-charged-toner cleaning member, to the toner on the body, and when the normally-charged-toner cleaning member is provided on an upstream side of the oppositely-charged-toner cleaning member in the surface moving direction, the normally-charged-toner cleaning member removes toner on the body electrostatically while applying an electric charge having a same polarity as a polarity of a voltage applied to the normally-charged-toner cleaning member, to the toner on the body, and when the oppositely-charged-toner cleaning member is provided on an upstream side of the normally-charged-toner cleaning member in the surface moving direction, a relative speed of the oppositely-charged-toner collecting member to the oppositely-charged-toner cleaning member at a contact portion between the oppositely-charged-toner collecting member and the oppositely-charged-toner cleaning member is set to be slower than a relative speed of the normally-charged-toner collecting member to the normally-charged-toner cleaning member at a contact portion between the normally-charged-toner collecting member and the normally-charged-toner cleaning member, and when the normally-charged-toner cleaning member is provided on an upstream side of the oppositely-charged-toner cleaning member in the surface moving direction, a relative speed of the normally-charged-toner collecting member to the normally-charged-toner cleaning member at a contact portion between the normally-charged-toner collecting member and the normally-charged-toner cleaning member is set to be slower than a relative speed of the oppositely-charged-toner collecting member to the oppositely-charged-toner cleaning member at a contact portion between the oppositely-charged-toner collecting member and the oppositely-charged-toner cleaning member.

6. An image forming apparatus that forms an image on a recording material by transferring a toner image formed on an image carrier finally from the image carrier to the recording material, the image forming apparatus comprising a cleaning device according to claim 1 used as a cleaning device configured to clean residual toner after transfer remaining on the image carrier after the transfer.

7. A cleaning device comprising:

a polarity control unit configured to control a charge polarity of toner on a body to be cleaned;

a cleaning member configured to be provided on a downstream of the polarity control unit in a surface moving direction of the body, to be applied with a voltage having a polarity opposite to the charge polarity of the toner controlled by the polarity control unit, and to electrostatically remove the toner on the body;

a pre-cleaning member configured to be provided on an upstream of the polarity control unit in the surface moving direction of the body, to be applied with a voltage having a polarity opposite to a normal charge polarity of the toner, and to electrostatically remove the toner having the normal charge polarity on the body;

a toner collecting member configured to be in contact with the cleaning member, and to collect toner adhering to the cleaning member; and a pre-collecting member configured to be in contact with the pre-cleaning member, and to collect toner adhering to the pre-cleaning member, wherein the cleaning device is configured to include at least one of the following configurations:

a relative speed of the cleaning member to the body at a contact portion between the cleaning member and the body is set to be slower than a relative speed of the pre-cleaning member to the body at a contact portion between the pre-cleaning member and the body, a biting depth of the cleaning member to the body is made an amount less than a biting depth of the pre-cleaning member to the body, a biting depth of the toner collecting member to the cleaning member is made an amount less than a biting depth of the pre-collecting member to the pre-cleaning member, and a relative speed of the toner collecting member to the cleaning member at a contact portion between the toner collecting member and the cleaning member is set to be slower than a relative speed of the pre-collecting member to the pre-cleaning member at a contact portion between the pre-collecting member and the pre-cleaning member.

8. The cleaning device according to claim 7, wherein, when the cleaning device includes:

the configuration that a biting depth of the cleaning member to the body is made less than a biting depth of the pre-cleaning member to the body, and the configuration that the relative speed of the cleaning member to the body to at the contact portion between the cleaning member and the body is set to be slower than the relative speed of the pre-cleaning member to the body at the contact portion between the pre-cleaning member and the body, the biting depth of the cleaning member to the body is made an additional amount less than the biting depth of the pre-cleaning member to the body.

9. The cleaning device according to claim 7, wherein, when the cleaning device includes the configuration that a biting depth of the toner collecting member to the cleaning member is made less than a biting depth of the pre-collecting member to the pre-cleaning member, and when the cleaning device further includes one of:

the configuration that the relative speed of the cleaning member to the body at the contact portion between the cleaning member and the body is set to be slower than the relative speed of the pre-cleaning member to the body at the contact portion between the pre-cleaning member and the body, and the configuration that the biting depth of the cleaning member to the body is made less than the biting depth of the pre-cleaning member to the body, the biting depth of the toner collecting member to the cleaning member is made an additional amount less than the biting depth of the pre-collecting member to the pre-cleaning member.

10. An image forming apparatus that forms an image on a recording material by transferring a toner image formed on an image carrier from the image carrier to the recording material, the image forming apparatus comprising a cleaning device according to claim 7 used as a cleaning device configured to clean residual toner after transfer remaining on the image carrier after the transfer.

* * * * *